US010123621B2

(12) United States Patent
Nelson et al.

(10) Patent No.: US 10,123,621 B2
(45) Date of Patent: Nov. 13, 2018

(54) FURNITURE SYSTEM RECLINER ASSEMBLY WITH SLED RAILS

(71) Applicant: THE LOVESAC COMPANY, Stamford, CT (US)

(72) Inventors: Shawn Nelson, Darien, CT (US); David Underwood, Norwalk, CT (US); Brian Kuchler, Stamford, CT (US)

(73) Assignee: THE LOVESAC COMPANY, Stamford, CT (US)

( * ) Notice: Subject to any disclaimer, the term of this patent is extended or adjusted under 35 U.S.C. 154(b) by 0 days.

(21) Appl. No.: 15/667,967

(22) Filed: Aug. 3, 2017

(65) Prior Publication Data

US 2018/0000244 A1 Jan. 4, 2018

Related U.S. Application Data

(63) Continuation-in-part of application No. 15/342,800, filed on Nov. 3, 2016.
(Continued)

(51) Int. Cl.
*A47C 7/00* (2006.01)
*A47C 1/02* (2006.01)
(Continued)

(52) U.S. Cl.
CPC ..... *A47C 1/0347* (2013.01); *A47C 1/0352* (2013.01); *A47C 1/03211* (2013.01);
(Continued)

(58) Field of Classification Search
CPC ..... A47C 17/04; A47C 17/17; A47C 1/124; A47C 1/0347; A47C 13/005
(Continued)

(56) References Cited

U.S. PATENT DOCUMENTS 988,059 A 3/1911 Allen
2,625,983 A 1/1953 Slyter et al.
(Continued)

FOREIGN PATENT DOCUMENTS

CN 203563950 U 10/1996
CN 203609079 U 9/2009
(Continued)

OTHER PUBLICATIONS

Non-Final Rejection of U.S. Appl. No. 15/342,800. (dated 2018).*
(Continued)

*Primary Examiner* — Mark R Wendell
(74) *Attorney, Agent, or Firm* — Workman Nydegger

(57) ABSTRACT

A furniture system with a reclining assembly including a modular furniture assembly and a reclining assembly. A passageway in the reclining assembly allows coupling to a slit in the modular furniture assembly with a coupler. The reclining assembly includes a housing and a footrest assembly that moves with respect to the housing. An additional base can be coupled to the front end of the footrest assembly, with one or more (e.g., two) sled rails mounted on an underside of the additional base, such that the additional base slides on the sled rails as the footrest assembly moves from the compressed non-reclined position to the extended position.

20 Claims, 16 Drawing Sheets

Related U.S. Application Data

(60) Provisional application No. 62/257,623, filed on Nov. 19, 2015.

(51) Int. Cl.

| | |
|---|---|
| ***A47C 1/032*** | (2006.01) |
| ***A47C 17/17*** | (2006.01) |
| ***A47C 1/035*** | (2006.01) |
| ***A47C 13/00*** | (2006.01) |
| ***A47C 17/04*** | (2006.01) |

(52) U.S. Cl.
CPC ..... *A47C 13/005* (2013.01); *A47C 17/04* (2013.01); *A47C 17/17* (2013.01)

(58) Field of Classification Search
USPC ..... 312/107, 108, 111; 297/440.1, 86
See application file for complete search history.

(56) References Cited

U.S. PATENT DOCUMENTS

| | | | |
|---|---|---|---|
| 2,653,648 | A | 9/1953 | Marshall |
| 3,113,633 | A | 12/1963 | Eberhardt et al. |
| 3,870,297 | A | 3/1975 | Elder |
| 3,893,731 | A | 7/1975 | Maggs |
| 4,124,249 | A | 11/1978 | Abbeloos |
| 4,321,717 | A | 3/1982 | Serra |
| 4,846,525 | A | 7/1989 | Maiming |
| 5,064,244 | A | 11/1991 | Sproule |
| 5,106,153 | A | 4/1992 | Durling |
| 5,362,296 | A | 11/1994 | Wang et al. |
| 5,368,359 | A | 11/1994 | Eakin |
| 5,544,938 | A | 8/1996 | Saul et al. |
| 5,683,139 | A | 11/1997 | Golynsky et al. |
| 5,735,573 | A | 4/1998 | Vredevoogd |
| 5,740,564 | A | 4/1998 | Hankins et al. |
| 5,790,993 | A | 8/1998 | Roma et al. |
| 5,895,365 | A | 4/1999 | Toniniskm |
| 5,967,820 | A | 10/1999 | Siegal et al. |
| 5,995,634 | A | 11/1999 | Zwolski |
| 6,000,353 | A | 12/1999 | De Leu |
| 6,000,758 | A | 12/1999 | Schaffner et al. |
| 6,322,146 | B1 | 11/2001 | Fisher, Jr. |
| 6,814,709 | B2 | 11/2004 | Schwartz et al. |
| 7,090,297 | B2 | 8/2006 | Mohn et al. |
| 7,172,196 | B2 | 2/2007 | Randall |
| 7,213,885 | B2 | 5/2007 | White et al. |
| D547,087 | S | 7/2007 | Natuzzi |
| 7,312,393 | B2 | 12/2007 | McCarthy |
| 7,419,220 | B2 | 9/2008 | White et al. |
| 7,421,608 | B2 | 9/2008 | Schron |
| 7,448,689 | B2 | 11/2008 | Carter |
| 7,547,073 | B2 | 6/2009 | White et al. |
| 7,553,288 | B2 | 6/2009 | Cohen |
| 7,575,279 | B2 | 8/2009 | Robertson |
| 7,631,937 | B2 | 12/2009 | Robertson |
| 7,699,389 | B2 | 4/2010 | Robertson |
| 7,735,912 | B2 | 6/2010 | Robertson |
| 7,766,421 | B2 | 8/2010 | Lawson |
| 7,871,280 | B2 | 1/2011 | Henriott |
| 7,918,308 | B2 | 4/2011 | Cohen |
| 7,963,612 | B2 | 6/2011 | Nelson et al. |
| 7,982,436 | B2 | 7/2011 | Randall |
| 8,061,864 | B2 | 11/2011 | Metcalf et al. |
| 8,132,856 | B2 | 3/2012 | Wilson et al. |
| 8,228,026 | B2 | 7/2012 | Johnson et al. |
| 8,421,407 | B2 | 4/2013 | Johnson |
| 8,668,045 | B2 | 3/2014 | Cohen |
| 8,783,778 | B2 | 7/2014 | Nelson et al. |
| 8,935,985 | B2 | 1/2015 | Hjelm |
| 9,010,851 | B2 | 4/2015 | LaPointe |
| 9,095,209 | B2 | 8/2015 | Mirth et al. |
| 9,124,308 | B2 | 9/2015 | Metcalf |
| 9,277,826 | B2 | 3/2016 | Nelson et al. |
| 2001/0020810 | A1 | 9/2001 | Kennedy |
| 2003/0025366 | A1 | 2/2003 | Barreiro, Jr. |
| 2003/0139693 | A1 | 7/2003 | Swift |
| 2004/0026998 | A1 | 2/2004 | Henriott et al. |
| 2004/0061943 | A1 | 4/2004 | Bosch et al. |
| 2004/0095000 | A1 | 5/2004 | Durling |
| 2005/0053252 | A1 | 3/2005 | Cohen |
| 2005/0253430 | A1 | 11/2005 | George et al. |
| 2006/0036201 | A1 | 2/2006 | Cohen |
| 2006/0061148 | A1 | 3/2006 | Pollard et al. |
| 2006/0076813 | A1 | 4/2006 | Mohn et al. |
| 2008/0012404 | A1 | 1/2008 | Dewert |
| 2008/0150329 | A1 | 6/2008 | Lawson |
| 2008/0262657 | A1 | 10/2008 | Howell et al. |
| 2009/0072782 | A1 | 3/2009 | Randall |
| 2009/0096255 | A1 | 4/2009 | Robertson |
| 2009/0212638 | A1 | 8/2009 | Johnson |
| 2009/0212639 | A1 | 8/2009 | Johnson |
| 2009/0212737 | A1 | 8/2009 | Johnson et al. |
| 2009/0250982 | A1 | 10/2009 | Cohen |
| 2010/0290215 | A1 | 11/2010 | Metcalf et al. |
| 2010/0320819 | A1 | 12/2010 | Cohen et al. |
| 2011/0012403 | A1 | 1/2011 | Wilson et al. |
| 2011/0109211 | A1 | 5/2011 | Kirkeby et al. |
| 2011/0110075 | A1 | 5/2011 | Smith |
| 2011/0298340 | A1 | 12/2011 | Nelson et al. |
| 2012/0026724 | A1 | 2/2012 | Metcalf et al. |
| 2012/0051579 | A1 | 3/2012 | Cohen |
| 2012/0200129 | A1 | 8/2012 | Wilson, Jr. |
| 2012/0286557 | A1 | 11/2012 | Hoffman et al. |
| 2013/0199421 | A1 | 8/2013 | Hjelm |
| 2013/0207478 | A1 | 8/2013 | Metcalf et al. |
| 2013/0234481 | A1 | 9/2013 | Johnson |
| 2014/0010387 | A1 | 1/2014 | Cohen |
| 2014/0197666 | A1 | 7/2014 | Koch |
| 2014/0285140 | A1 | 9/2014 | Jung |
| 2015/0069965 | A1 | 3/2015 | Verschueren |
| 2015/0076881 | A1 | 3/2015 | LaPointe et al. |
| 2015/0076891 | A1 | 3/2015 | LaPointe et al. |
| 2016/0174715 | A1 | 6/2016 | Nelson et al. |
| 2017/0143122 | A1 | 5/2017 | Nelson et al. |

FOREIGN PATENT DOCUMENTS

| | | | |
|---|---|---|---|
| CN | 2236262 | Y | 10/2012 |
| CN | 201341645 | Y | 11/2012 |
| CN | 201452358 | U | 4/2013 |
| CN | 202553058 | U | 6/2013 |
| CN | 202907151 | U | 4/2014 |
| CN | 202981088 | U | 5/2014 |
| WO | 2017087266 | | 4/2013 |
| WO | 2017087268 | | 6/2013 |
| WO | 2012093398 | | 5/2017 |
| WO | 2017087224 | | 5/2017 |

OTHER PUBLICATIONS 2014072975 and International Search Report (57 pages), WO, dated Nov. 28, 2012, Ozana et al.

2009113319 with English abstract and International Search Report (47 pages), WO, dated May 15, 2014, Sakuji et al.

http://homefurniturecomponents.com, A foundation of comfort, printed on Oct. 21, 2016, 12 pages.

http://homefurniturecomponents.com, A foundation of comfort, printed on Oct. 4, 2016, 1 page.

http://homefurniturecomponents.com, EasyCliner+, printed on Oct. 21, 2016, 1 page.

http://homefurniturecomponents.com, EZ Series Brochure, printed on Oct. 21, 2016, 1 page.

http://homefurniturecomponents.com, InSpira Lounging Ingenuity video link Features and Benefits of InSpira, printed on Oct. 21, 2016, 1 page.

http://homefurniturecomponents.com, Omega Wall Hugger, printed on Oct. 21, 2016, 1 page.

Invitation to Pay Additional Fees and, Where Applicable, Protest Fee, from International Application No. PCT/US16/61491, dated Jan. 24, 2017.

(56) References Cited

OTHER PUBLICATIONS

Notification of Transmittal of The International Search Report and The Written Opinion of the International Searching Authority, or the Declaration, from International Application No. PCT/US16/61085, dated Jan. 31, 2017, 11 pages.
Office Action from U.S. Appl. No. 13/869,600, dated Dec. 15, 2015 (9 pages).
Pictures of Recliner Mechanism, dated Oct. 12, 2016, 3 pages.
The Wall Street Journal newspaper article entitled, "Wireless Charging Everywhere," dated Dec. 30, 2015.
U.S. Appl. No. 60/778,761, entitled Power Delivery Surface Power Supply Safety, filed Mar. 3, 2006 (59 pages).
www.HomeFurnitureComponents.com, 300ez One-Motor Lift Mechanism, printed on Oct. 21, 2016, 1 page.
www.HomeFurnitureComponents.com, 350ez Recliner Mechanism, printed on Oct. 21, 2016, 1 page.
www.HomeFurnitureComponents.com, 350ez Series Recliner Mechanism, printed on Oct. 21, 2016, 1 page.
www.HomeFurnitureComponents.com, InSpira Lounging Ingenuity video screen shots, printed on Oct. 21, 2016, 10 pages.
www.HomeFurnitureComponents.com, InSpira Lounging Ingenuity, printed on Oct. 20, 2016, 1 page.
Pages from http://www.recliner-handles.com:80/, available, on information and belief, at least as early as Jun. 4, 2016, 6 pages.
Pages from http://www.recliner-handles.com, available, on information and belief, at least as early as Nov. 1, 2016, 3 pages.
Page from archive.org for www.romag.com available, on information and belief, at least as early as Jan. 31, 2016, 1 page.
Page from archive.org for www.romag.com available, in information and belief, at least as early as Jun. 10, 2016, 1 page.
Page from archive.org for www.romag.com available, on information and belief, at least as early as Oct. 17, 2015, 1 page.
U.S. Appl. No. 15/342,800, Jun. 26, 2018, Amendment B.
U.S. Appl. No. 15/342,800, Mar. 16, 2018, Office Action.

* cited by examiner

FURNITURE SYSTEM RECLINER ASSEMBLY WITH SLED RAILS

CROSS-REFERENCE TO RELATED APPLICATIONS

This application is a continuation-in-part of U.S. patent application Ser. No. 15/342,800, filed on Nov. 3, 2016, entitled FURNITURE SYSTEM WITH RECLINER ASSEMBLY, which claims priority to and the benefit of U.S. Provisional Patent Application Ser. No. 62/257,623, filed on Nov. 19, 2015, entitled FURNITURE WITH ELECTRONIC ASSEMBLIES, each of which is incorporated herein by reference in its entirety.

THE FIELD OF THE INVENTION

This invention is in the field of furniture systems with recliners.

THE RELEVANT TECHNOLOGY

Modular furniture is advantageous in part because it enables a variety of different furniture configurations to be created using a limited number of parts and because in manufacturing and design, only a limited number of designs are needed, simplifying the manufacturing and supply process. Modular furniture is therefore both efficient, convenient and valuable. It is also important that modular furniture be comfortable so that users will want to sit and remain seated in a sofa configuration, for example, or in a chair or other furniture system.

Traditional furniture has evolved into a variety of different furniture configurations that enable the user to sit comfortably in a variety of different seated positions. For example, traditional furniture features extensive numbers of pieces in order to create a large couch, or a sectional seating configuration in which a number of people can enjoy sitting together to engage in an activity or to watch television or a movie together as a group or family, for example. Recliners, for example, can be used to move from a sitting position to a reclining position in order to further relax the muscles of the back. Typical recliners, however, often have a bulky, mechanized appearance that is not aesthetically pleasing or contiguous with the appearance of neighboring furniture pieces. It is often possible to tell which piece is a recliner, often yielding an unpleasant and non-unified appearance.

Furthermore, many traditional recliners included in sectional couches cannot be positioned closely against a wall because the backrest of the recliner section will often need space behind it in order to recline. This requires the placement of the entire sectional couch system to be sufficiently far away from a wall to allow for the recliner section to recline. This may reduce the usable space within a room and or leave undesired spaces between the furniture and the wall.

What is needed is modular furniture system that also has some of the advantages and comforts of large traditional seating systems so that a user of modular furniture can also enjoy the benefits of a large seating system.

BRIEF SUMMARY OF THE INVENTION

The present invention relates to a furniture system comprised of: (i) a modular furniture assembly; and (ii) a reclining assembly positioned adjacent the modular furniture assembly and coupled thereto. The reclining assembly is configured to have a footprint that substantially fits within the mathematical specifications of the footprint of the modular furniture assembly. The reclining assembly also has a general appearance that is substantially similar to the modular furniture assembly when the reclining assembly is in the un-reclined position, thereby providing an aesthetically pleasing, unified appearance.

As a result, in the un-reclined position, the reclining assembly substantially appears to be another modular furniture assembly, rather than a bulky recliner placed next to a modular furniture assembly. Thus, a coherent, unified couch design and configuration can be created when the reclining assembly is mounted adjacent a modular furniture assembly of the furniture system. In some embodiments, the reclining assembly appears to be another portion of the modular furniture assembly, as opposed to appearing to be a bulky mechanized recliner. The collective reclining assembly and modular furniture assembly thus form an aesthetically pleasing and unified/coherent furniture system which does not stand out awkwardly as a typical recliner and does not have an unpleasant appearance of a typical recliner incongruously placed onto the end of a furniture system.

Instead, the furniture system of the present invention is comprised of: (i) a modular furniture assembly; and (ii) a reclining assembly positioned adjacent the modular furniture assembly and coupled thereto in a unified, aesthetically pleasing manner such that the reclining assembly generally has the appearance of another modular furniture assembly, rather than a bulky, awkward recliner.

In one embodiment of the present invention, the modular furniture assembly is comprised of: (i) a base member for sitting on by a user; and (ii) a transverse member configured to be used as a backrest and/or an arm rest. Such modular furniture assemblies are highly advantageous, particularly in the dimensions which have a ratio of $x=x'=y+z$ wherein x is the length of the base, x' is the length of a transverse member and wherein y is the width of the base and z is the width of the transverse member. This $x=x'=y+z$ relationship enables a variety of different furniture configurations to be formed, using only the design of the base and the design of the transverse member, as mentioned in the patents and applications incorporated herein by reference.

The reclining assembly of the present invention enables reclining in a system that employs a ratio similar to the $x=x'=y+z$ ratio.

In one embodiment, the reclining assembly is comprised of a base configured to be mounted on a support surface and a backrest mounted on the base. The base is comprised of a two-piece framework having a length x" and a width x'" wherein the framework is a rectangular framework and wherein $x''=x'''$. The framework comprises: (A) a housing, which rests on the floor and (B) a footrest assembly. The base further comprises a recliner mechanism mounted within the housing and coupled to the footrest assembly, the recliner mechanism selectively moving the footrest assembly with respect to the housing. The backrest is coupled to the recliner mechanism. The recliner framework remains or substantially remains within the $x''=x'''$ footprint in the compressed position and at least a portion of the footrest assembly moves out of the $x''=x'''$ footprint in the extended position.

By substantially remaining within the $x''=x'''$ footprint, the recliner assembly has a similar footprint to the $x=x'=y+z$ footprint of the modular furniture assembly adjacent to which the reclining assembly is placed. Also, by being configured to have a similar appearance as the modular furniture assembly, the reclining assembly thus appears to be another modular furniture assembly, not a bulky, awkward recliner.

The reclining assembly can be used in a variety of different locations within the modular furniture assembly configurations, such as on the side of a modular furniture assembly, in the middle of a modular furniture assembly comprising many pieces, or a variety of different locations, any of which can be employed within a small, medium or large assembly of furniture. The recliner assembly also has panels that hide the reclining mechanism, making the reclining assembly more aesthetically appealing.

In one embodiment, the invention comprises: A furniture system, comprising: (A) a modular furniture assembly having footprint specifications which identify the footprint of the modular furniture assembly, the modular furniture assembly comprising a base and a transverse member that can be selectively coupled to each other; and (B) a reclining assembly configured to be selectively coupled to the modular furniture assembly, wherein the reclining assembly is configured to be mounted adjacent to the modular furniture assembly such that the reclining assembly can be selectively coupled to the modular furniture assembly to form a convenient, useful, and aesthetically pleasing sofa, wherein, in a compressed, non-reclined position, the reclining assembly has substantially the same footprint specifications as the footprint specifications of the modular furniture assembly.

In another embodiment, the furniture assembly comprises a furniture system, comprising: (A) a modular furniture assembly comprising a base and a transverse member that can be selectively coupled to each other; and (B) a reclining assembly configured to be selectively coupled to the modular furniture assembly, wherein the reclining assembly is configured to be mounted adjacent to the modular furniture assembly such that the reclining assembly can be selectively coupled to the modular furniture assembly to form a sofa, wherein the reclining assembly comprises: (1) a base configured to be mounted on a support surface, the base comprising: (i) a housing; and (ii) a footrest assembly that moves with respect to the housing, and wherein a passageway extends between the housing and the footrest assembly such that a coupler is selectively mounted within the passageway and within a corresponding slit of the modular furniture assembly to thereby couple the reclining assembly to the modular furniture assembly.

Another embodiment is directed to a furniture system that includes a modular furniture assembly having footprint specifications which identify the footprint of the modular furniture assembly, the modular furniture assembly comprising a base and a transverse member that can be selectively coupled to each other, and a reclining assembly configured to be selectively coupled to the modular furniture assembly, wherein the reclining assembly is configured to be mounted adjacent to the modular furniture assembly such that the reclining assembly can be selectively coupled to the modular furniture assembly to form a convenient, useful, and aesthetically pleasing sofa. In a compressed, non-reclined position, the reclining assembly has substantially the same footprint specifications as the footprint specifications of the modular furniture assembly. The reclining assembly includes (i) a housing; (ii) a footrest assembly; and (iii) a recliner mechanism configured to selectively move the footrest assembly with respect to the housing. An additional base is mountable to a front end of the footrest assembly of the reclining assembly, the additional base moving with the footrest assembly. The additional base includes at least one sled rail (e.g., two rails) mounted on an underside of the additional base.

Another furniture assembly includes a modular furniture assembly having footprint specifications which identify the footprint of the modular furniture assembly, the modular furniture assembly comprising a base and a transverse member that can be selectively coupled to each other. A reclining assembly configured to be selectively coupled to the modular furniture assembly is also provided, wherein the reclining assembly is configured to be mounted adjacent to the modular furniture assembly such that the reclining assembly can be selectively coupled to the modular furniture assembly to form a convenient, useful, and aesthetically pleasing sofa. The reclining assembly includes (i) a housing; (ii) a footrest assembly that moves relative to the housing as the reclining assembly moves from a compressed, non-reclined position to an extended position; and (iii) a recliner mechanism configured to selectively move the footrest assembly with respect to the housing, wherein the footrest assembly includes at least one sled rail mounted on an underside of the footrest assembly. In an embodiment, the footrest assembly can include an additional base that is separable from the recliner assembly, where the sled rail(s) are mounted on the underside of the additional base.

Another embodiment is directed to a method for mounting a recliner assembly adjacent a modular furniture assembly. The method includes providing a modular furniture assembly with reclining assembly such as any of those described above or elsewhere herein, providing a first coupler configured to be placed within the modular furniture assembly and the reclining assembly, providing a second coupler configured to be placed within the reclining assembly and the additional base (or a footrest assembly that includes an additional base), placing the modular furniture assembly adjacent the reclining assembly and the additional base adjacent the reclining assembly, mounting the first coupler within the modular furniture assembly and the reclining assembly, coupling them to one another; and mounting the second coupler within the reclining assembly and the additional base (or footrest assembly that includes such), coupling them to one another.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which:

FIG. 10A shows the recliner assembly in an un-reclined position. FIG. 10B shows an underside of the recliner assembly, and FIG. 10C shows the recliner assembly in a reclined position.

FIG. 11A shows one or more felt shoes exploded from the underside of the sled rail, while FIG. 11B shows the felt shoe(s) attached to the underside of the sled rail. FIG. 11C shows an end view, and FIG. 11D a side elevation view of the sled rail, respectively, illustrating the tapered and curved outer edge thereof.

DETAILED DESCRIPTION OF THE PREFERRED EMBODIMENTS

Figure 1A:
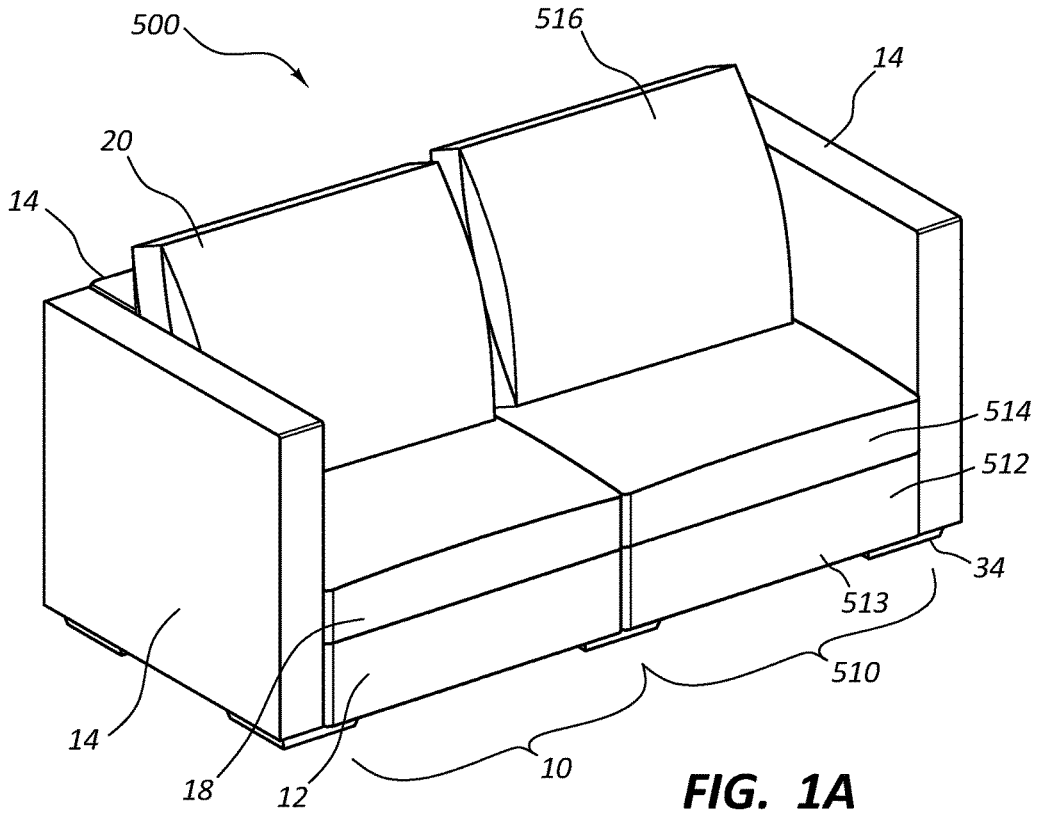
FIG. 1A is a perspective view of a furniture system 500 of the present invention in the form of a sofa with a reclining assembly 510 shown in a compressed (non-reclined) position and having an appearance similar to the adjacent modular furniture assembly 10, which is selectively coupled to the reclining assembly 510.
Figure 1B:
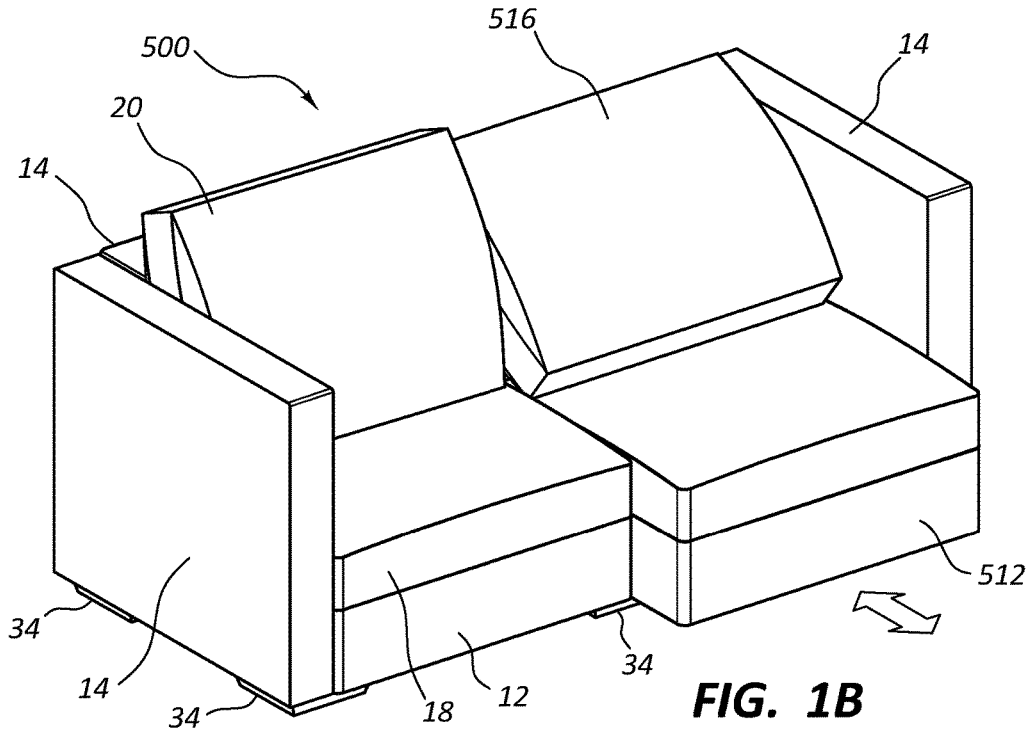
FIG. 1B is a perspective view of the furniture system of FIG. 1A with the reclining assembly shown in an extended, reclined position.

FIG. 1A is a perspective view of a furniture system 500 of the present invention with a reclining assembly 510 shown in a compressed (non-reclined) position. FIG. 1B is a perspective view of the furniture system of FIG. 1A with the reclining assembly 510 shown in an extended, reclined position.

As shown in FIGS. 1A-1B, the furniture system 500 is a sofa comprised of: (i) a modular furniture assembly 10; and (ii) a reclining assembly 510 positioned adjacent the modular furniture assembly 10 and selectively coupled thereto in a unified, aesthetically pleasing manner such that the reclining assembly 510 generally has the appearance of another modular furniture assembly, rather than a bulky, awkward meachanized recliner.

The modular furniture assembly 10 of FIGS. 1A-1B and FIGS. 2A-2B is comprised of: (i) a base member 12 for sitting on by a user; and (ii) a transverse member 14 configured to be used as a backrest and/or an arm rest. Such modular furniture assemblies are highly advantageous, particularly those having a ratio of $x=x'=y+z$ wherein x is the length of the base, x' is the length of the transverse member and wherein y equals the width of the base and z equals the width of the transverse member. This $x=x'=y+z$ relationship enables a variety of different furniture configurations to be formed, using only the design of the base and the design of the transverse member.

Base member 12 is selectively coupled to transverse member 14 and interacts with transverse member 14 as described in (i) U.S. patent application Ser. No. 14/332,705, filed Jul. 16, 2014, entitled MOUNTING PLATFORM FOR MODULAR FURNITURE ASSEMBLY, (ii) U.S. Pat. No. 8,783,778, entitled MOUNTING PLATFORM FOR MODULAR FURNITURE ASSEMBLY, (iii) U.S. Pat. No. 7,963,612 entitled MODULAR FURNITURE ASSEMBLY, (iv) U.S. patent application Ser. No. 11/449,074, filed Jun. 8, 2006, entitled MODULAR FURNITURE ASSEMBLY, now U.S. Pat. No. 7,547,073, (v) U.S. Pat. No. 7,213,885 entitled MODULAR FURNITURE ASSEMBLY, (vi) U.S. Provisional Application No. 62/354,426 filed Jun. 24, 2016 entitled MODULAR FURNITURE ASSEMBLY CORNER SEATING SYSTEM; (vii) U.S. Provisional Patent Application Ser. No. 62/257,623, filed on Nov. 19, 2015, entitled FURNITURE WITH ELECTRONIC ASSEMBLIES; (viii) U.S. patent application Ser. No. 15/270,339, filed on Sep. 20, 2016, entitled ELECTRICAL HUB FOR FURNITURE ASSEMBLIES; and (ix) U.S. patent application Ser. No. 15/276,524, filed Sep. 26, 2016, entitled Modular Furniture Assembly Corner Seating System, each of which are incorporated herein by reference.

As shown in FIGS. 1A-2B, modular furniture assembly 10 is comprised of a base member 12, one or more transverse members 14, a seat cushioning member 18 mounted on base member 12 and a back cushioning member 20 mounted adjacent a transverse member 14. Transverse member 14 is selectively coupled to base member 12 by coupler 15 and one or more foot couplers 34. Other couplers 15 and foot couplers 34 can be used to connect additional transverse members 14 to one or more bases 12, e.g., as backrests or armrests as shown in FIG. 1B, which also shows a transverse member 14 coupled to reclining assembly 510 as an armrest.

Figure 2A:
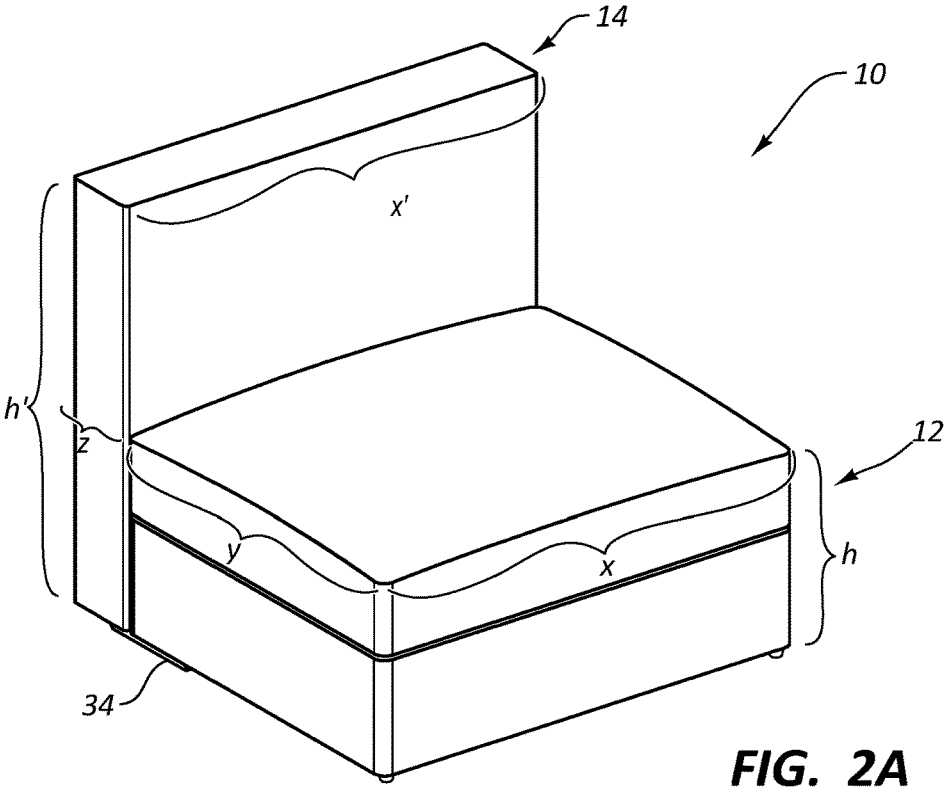
FIG. 2A is a perspective view of the modular furniture assembly of FIG. 1.
Figure 2B:
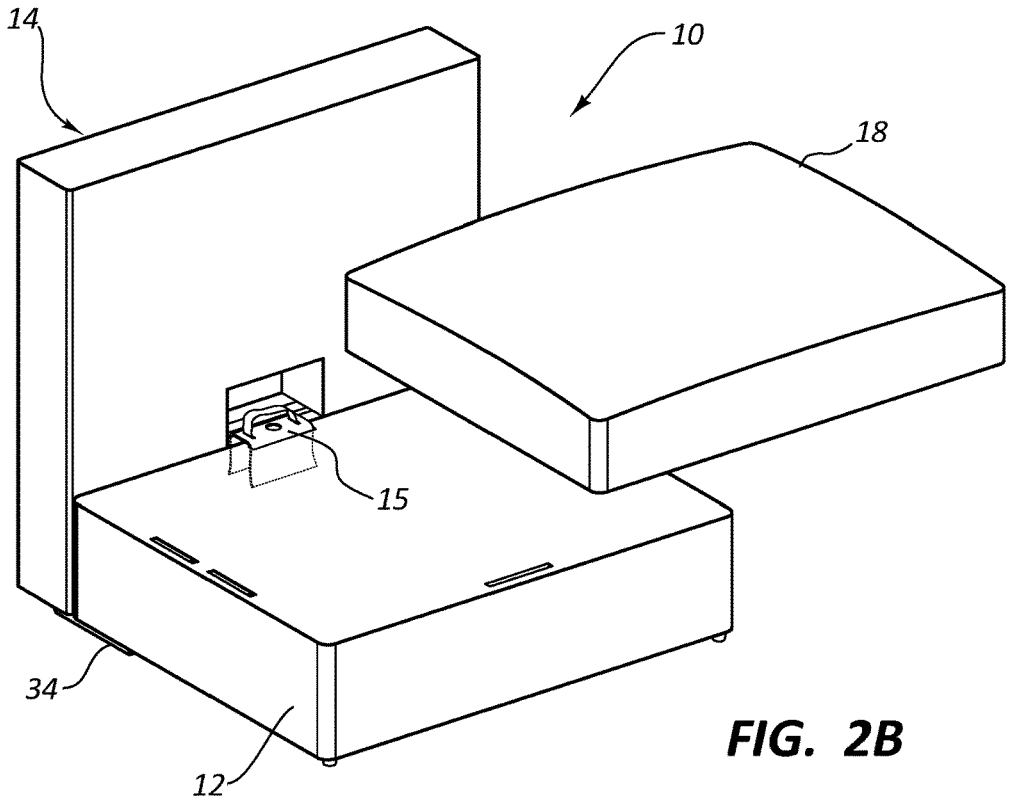
FIG. 2B is an exploded view of the modular furniture of FIGS. 1 and 2A.

In the embodiment of FIGS. 2A and 2B as discussed in U.S. Pat. No. 7,213,885, which is incorporated herein by reference, the length x of base 12 is substantially equal to the length x' of transverse member, each of which are substantially equal to the width y of base plus the width z of transverse member, such that x=x'=y+z. This dynamic of x=x'=y+z enables a variety of different furniture configurations to be formed and is an efficient configuration for a furniture system.

Seat cushion 18 can be selectively attached to base 12, e.g., through the use of a two-part attachment member such as VELCRO.

Figure 3A:
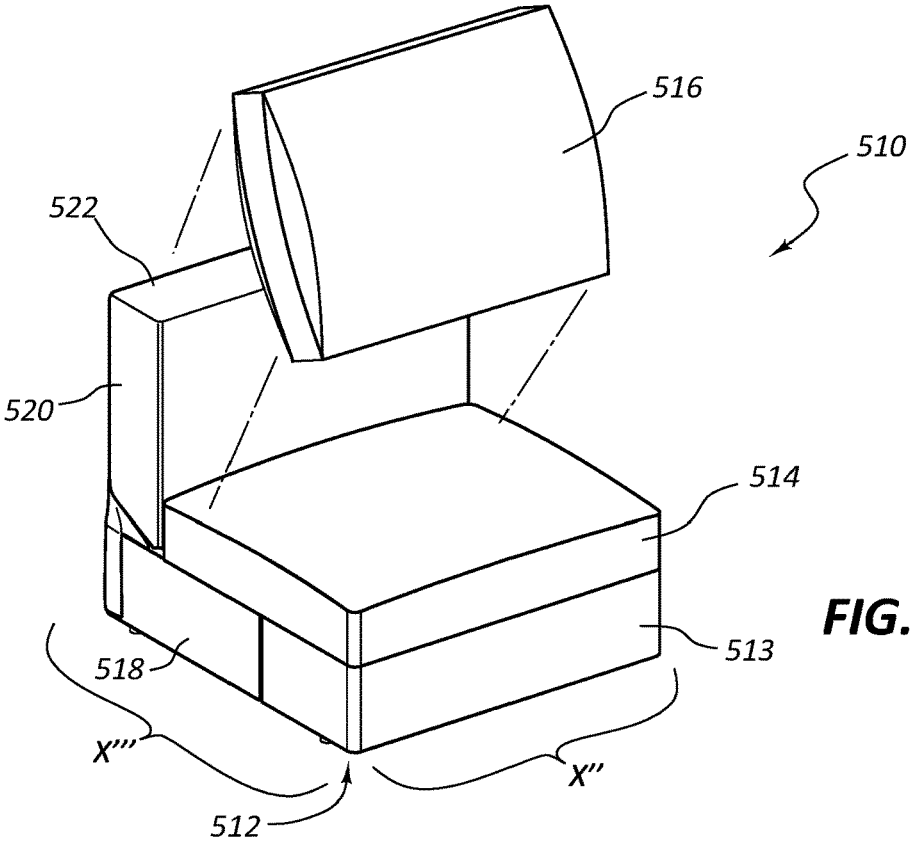
FIG. 3A is a perspective view of the reclining assembly of FIG. 1 in a compressed position with a back cushion exploded therefrom.
Figure 3B:
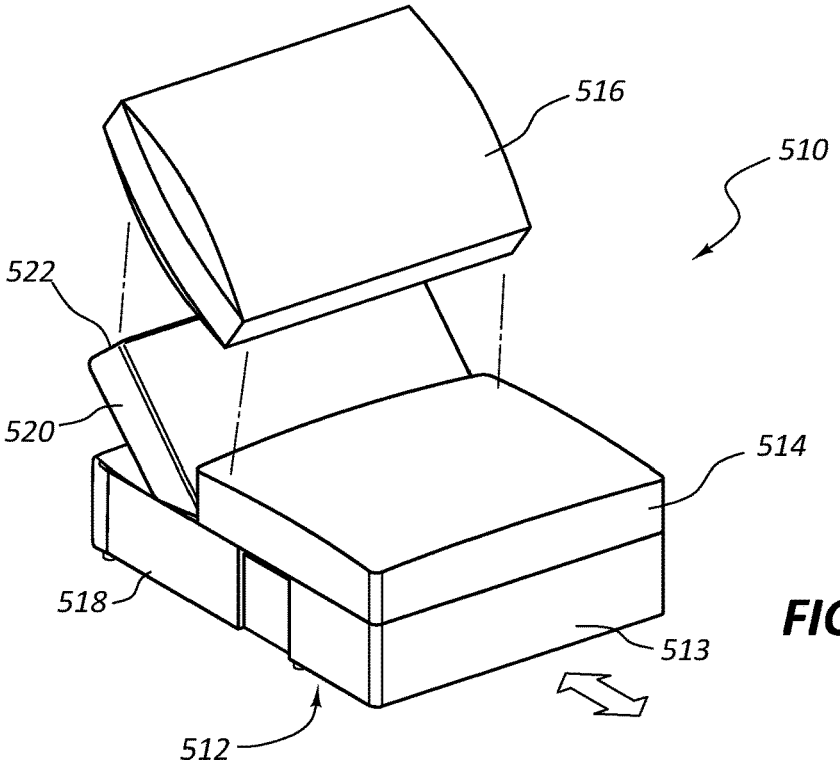
FIG. 3B is a perspective view of the reclining assembly of FIGS. 1 and 3A in an extended, reclined position.

Also as shown in FIGS. 1A-1B and as further shown in FIGS. 3A-B, reclining assembly 510 is comprised of a base 512 configured to be mounted on a support surface. Base 512 includes a footrest assembly 513 and a seat cushion 514 is mounted on the footrest assembly 513, upon which a back cushion 516 is mounted. A backrest 520 is mounted on the base 512, as discussed further in additional detail below.

The reclining assembly 510 is configured to have a footprint that substantially fits within the mathematical specifications of the footprint of the modular furniture assembly 10 and has a similar overall aesthetically appearance. Thus, as shown in FIG. 1A, reclining assembly 510 appears to be another modular furniture assembly 10 and does not have bulky, awkward looking mechanized parts shown to a consumer or user. As shown in FIG. 1A, the reclining assembly 510 has the general appearance that is similar to the modular furniture assembly 10 when the reclining assembly 510 is in the un-reclined position. In the compressed, non-reclined position, reclining assembly 510 uses approximately the same amount of footprint as the amount of footprint used by modular furniture assembly 10.

Thus, as shown in FIG. 1A, the combination of the modular furniture assembly 10 and the reclining assembly 510 generates a unified, aesthetically pleasing looking couch, which looks like two modular furniture assemblies mounted next to each other, rather than appearing to have an awkward bulky, mechanized recliner mounted next to a modular furniture assembly. Thus, as shown in FIG. 1A, a coherent, unified couch design and configuration can be created when the reclining assembly 510 is mounted adjacent a modular furniture assembly 10 of the furniture system 500.

FIG. 3A is a perspective view of reclining assembly 510 in a compressed position with the back cushion 516 exploded therefrom. FIG. 3B is a perspective view of the reclining assembly 510 in an extended, reclined position. As shown in these figures, the base 512 of recliner assembly is comprised of a footrest assembly 513 and a housing 518, wherein the footrest assembly 513 selectively moves outwardly with respect to housing 518, creating a comfortable footrest for a user, e.g., through the use of a wired remote controller, a wireless remote controller, buttons on a portion of the assembly 510, and/or a software application on a mobile device (e.g., a cellular phone), for example. Seat cushion 514 is mounted on the footrest assembly 513 portion of base 513, e.g. through the use of two part coupler, such as VELCRO, for example, and moves outwardly with footrest assembly 513 as footrest assembly 513 is moved to the extended position of FIG. 3B.

As shown in FIGS. 3A, in the non-reclined compact position, base 512 is comprised of: (i) a two-piece framework having a length x" and a width x'" wherein the framework is a rectangular framework and wherein x" x'" The framework of base 512 comprises: (A) a housing 518, which rests on the floor; and (B) movable footrest assembly 513 which moves with respect to housing 518. Base 512 further comprises a recliner mechanism 534 (FIGS. 7A-B) mounted within the housing 518 and coupled to the footrest assembly 513, the recliner mechanism 534 selectively moving the footrest assembly 513 with respect to the housing 518. The backrest 520 is coupled to the recliner mechanism 534 (FIGS. 7A-B) of the base 512. The recliner framework remains within the x"=x'" footprint in the compressed position of FIG. 3A and at least a portion of the footrest assembly 513 moves out of the x"=x'" footprint in the extended position (FIG. 3B).

Backrest 520 of recliner assembly 510 is mounted on the brackets 532 of reclining mechanism 534 (FIGS. 7A-B), the free end 522 of backrest 520 selectively reclining or inclining as illustrated in FIG. 3B when assembly 510 is moved to the extended, reclined position and back to the non-reclined position.

The reclining assembly 510 of FIGS. 1A-1B and FIGS. 3A-3B enables reclining in a system that employs a footprint having a ratio similar to the x=x'=y+z ratio. As reflected in FIGS. 1A and 3A, in the compressed position, base 512 has an overall footprint wherein base 512 has a length of x" which is substantially equal to the width x'" of base 512. As a result, in the reclining assembly, the length x" and the width x'" are substantially equal to each other and are also substantially equal to the length x of base member 12 which is substantially equal to the length x' of transverse member 14, each of which are substantially equal to the width y of the base member 12 plus the width z of the transverse member 14. Thus x=x'=x"=x'"=y+z. As a result, the mathematical specifications of the footprint used by the modular furniture assembly 10 of FIG. 2A are the same or substantially the same as the mathematical specifications of the footprint used by reclining assembly 510 of FIG. 3A.

As a result, in the embodiment of FIG. 1A, the reclining assembly 510 sits adjacent the modular furniture assembly 10 and appears to be another modular furniture assembly adjacent thereto, rather than a bulky mechanized recliner. In fact, however, the recliner assembly 510 selectively reclines with respect to modular furniture assembly 10.

The reclining assembly 510 is thus advantageous in part because it fits aesthetically and pleasingly adjacent modular furniture assembly 10 which has a configuration of $x=x^1=y+z$ and in part because it uses the same or similar amount of footprint used by modular furniture assembly 10. As a result, it fits in an aesthetically pleasing manner within system 500 and is both functionally efficient and pleasing to the eye.

As shown in FIG. 3B, housing 518 of recliner assembly 510 rests on the floor while moveable footrest assembly 513 moves outwardly with respect to housing 518 and free end 522 of backrest 520 simulating moves downwardly towards housing 518. Thus footrest assembly 513 and backrest 520 selectively move simultaneously, footrest assembly 513 moving back and forth while backrest 520 moves up and down.

In one embodiment, the backrest of the present invention can be configured to transition between the compressed, non-reclining position to the extended, reclined position without moving the free end of the backrest backwards or substantially backwards toward a wall adjacent to which the recliner is placed; in this embodiment, the lower portion of the backrest moves sufficiently forward during reclining that the free end of the backrest does not move substantially backward toward the wall as the recliner reclines. This can allow the reclining assembly, and therefore any other assemblies adjacent to the reclining assembly, to be placed with the backrest in contact, or nearly in contact with, a wall. The reclining mechanism may be a wall-hugging mechanism, for example. This allow users to place associated modular furniture systems directly next to a wall, saving floor space within a room and avoiding unnecessary space between the furniture and the wall. Thus, in one embodiment, the recliner assembly of the present invention can be situated with the backrest in contact or nearly in contact with a wall when the reclining assembly is in a compressed, non-reclined position and the free end of the backrest does extend substantially backwards towards the wall as the recliner assembly is moved to an extended, reclined position.

Figure 4A:
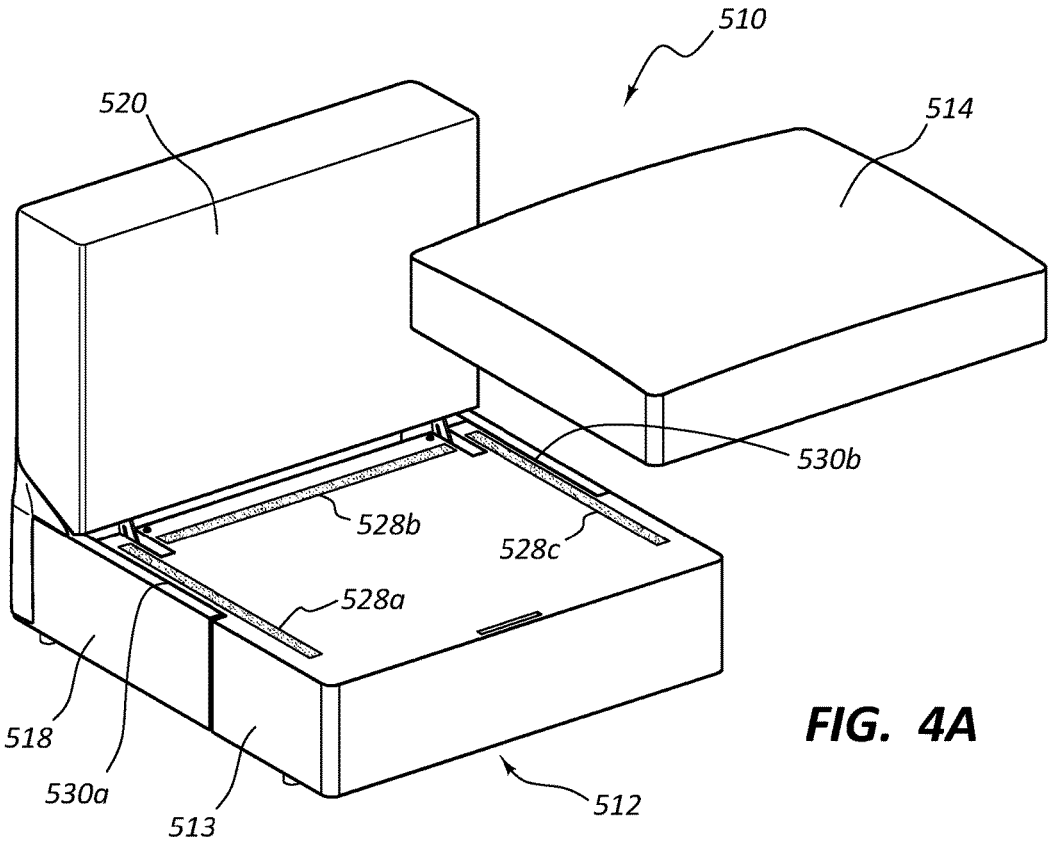
FIG. 4A is a perspective view of the reclining assembly of FIGS. 1 and 4A in a compressed position with a seat cushion exploded therefrom.
Figure 4B:
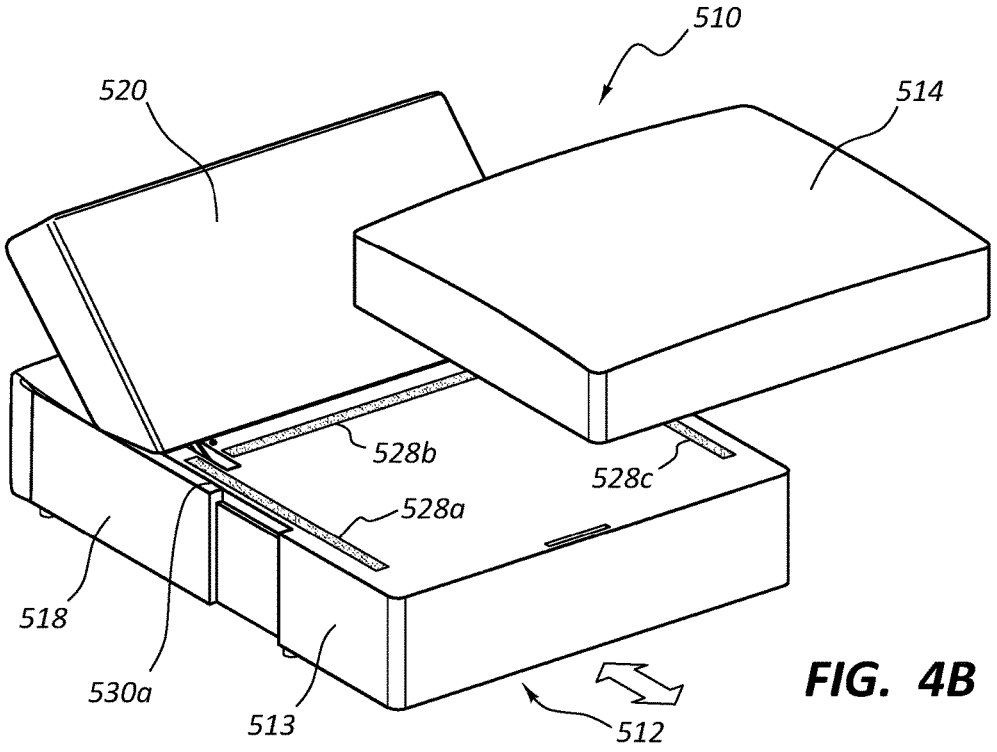
FIG. 4B is a perspective view of the reclining assembly of FIG. 4A in an extended, reclined position.

FIG. 4A is a perspective view of the reclining assembly 510 in a compressed position with seat cushion 514 exploded therefrom. FIG. 4B is a perspective view of the reclining assembly of FIG. 4A in an extended, reclined position.

FIGS. 4A-B show that the housing 518 of base 512 is configured to be mounted on a support surface, such as a floor and that footrest assembly 513 of base 512 selectively moves outwardly therefrom into an extended position as backrest 520 mounted on base 512 simultaneously reclines to the reclined position. Two part couplers such as VELRCO strips 528A-C mounted on the upper face of footrest assembly 513 and the lower face of cushion 514 respectively maintain cushion 514 on footrest assembly 513 as footrest assembly 513 moves to the extended position.

Figure 6:
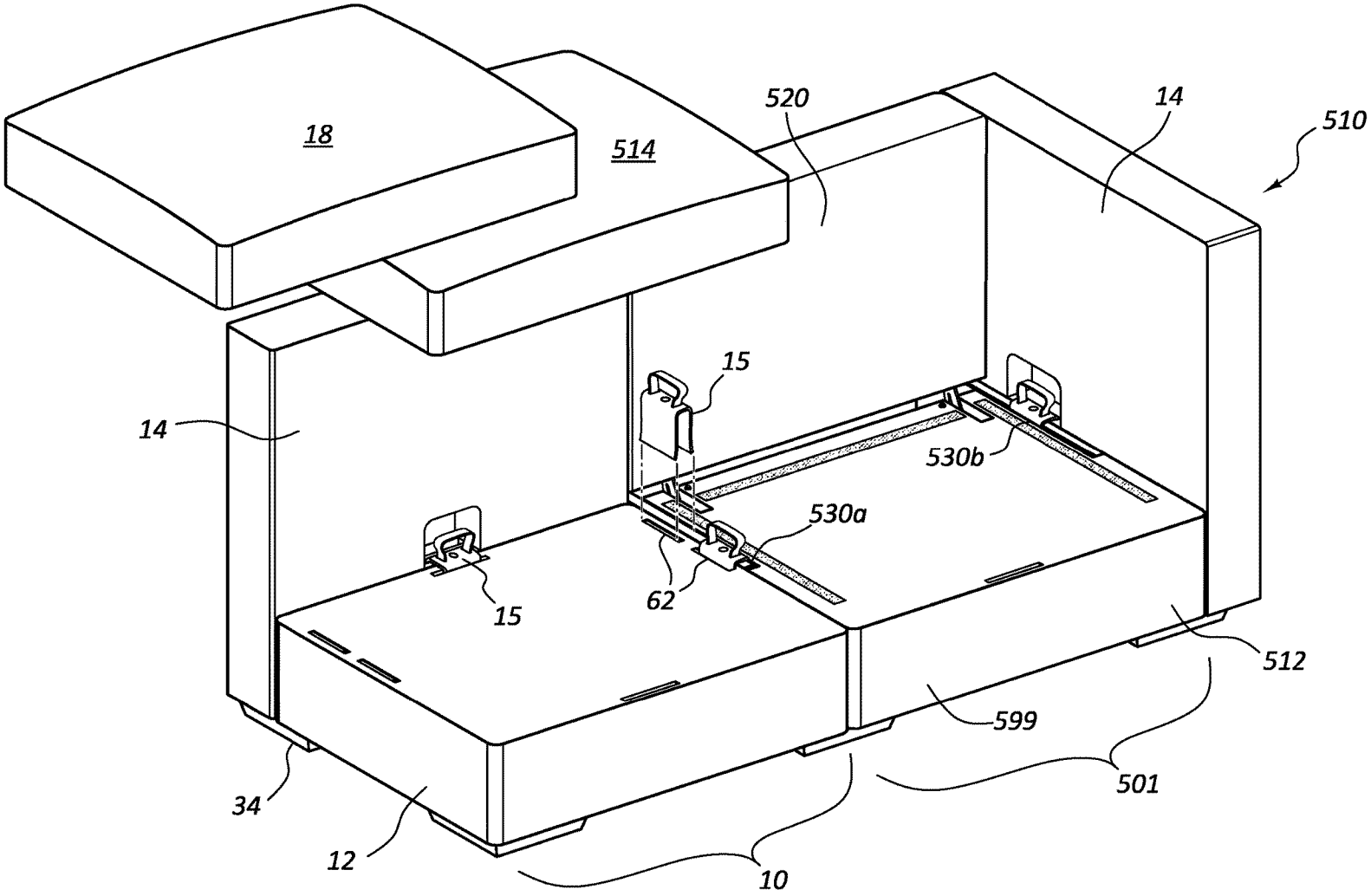
FIG. 6 demonstrates the connection of the reclining assembly of FIG. 1A to the modular furniture assembly of FIG. 1A to form the furniture system of FIG. 1A.

FIGS. 4A-B further show passageways 530*a-b* on opposing sides of base 512 that are defined at the interface of the respective side edges of the footrest assembly 513 and housing 518. Couplers, such as couplers 15 of FIG. 6 are selectively placed in respective passageways 530*a-b* in order to couple a side of recliner assembly 510 to: (i) a base 12 of modular furniture assembly 10; (ii) another base 512 of a recliner assembly 510; or (iii) a transverse member 14. Examples of these connections are shown in FIGS. 1A-B and FIG. 6, for example.

Figure 4C:
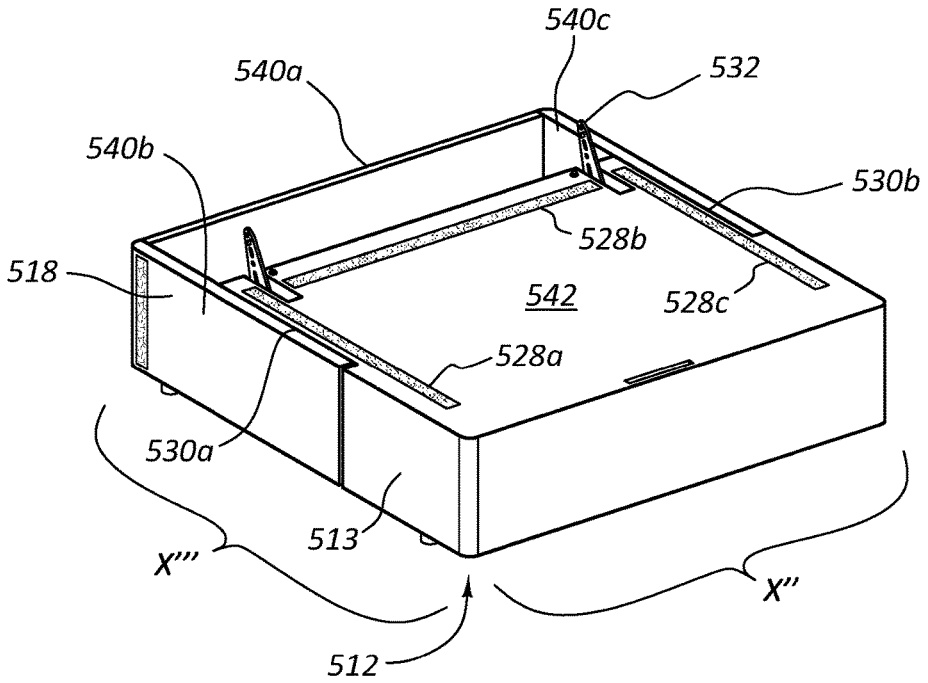
FIG. 4C is a perspective view of the base of the reclining assembly of FIG. 4A with the backrest removed and with the brackets of the reclining mechanism in the compressed, non-reclined position.
Figure 4D:
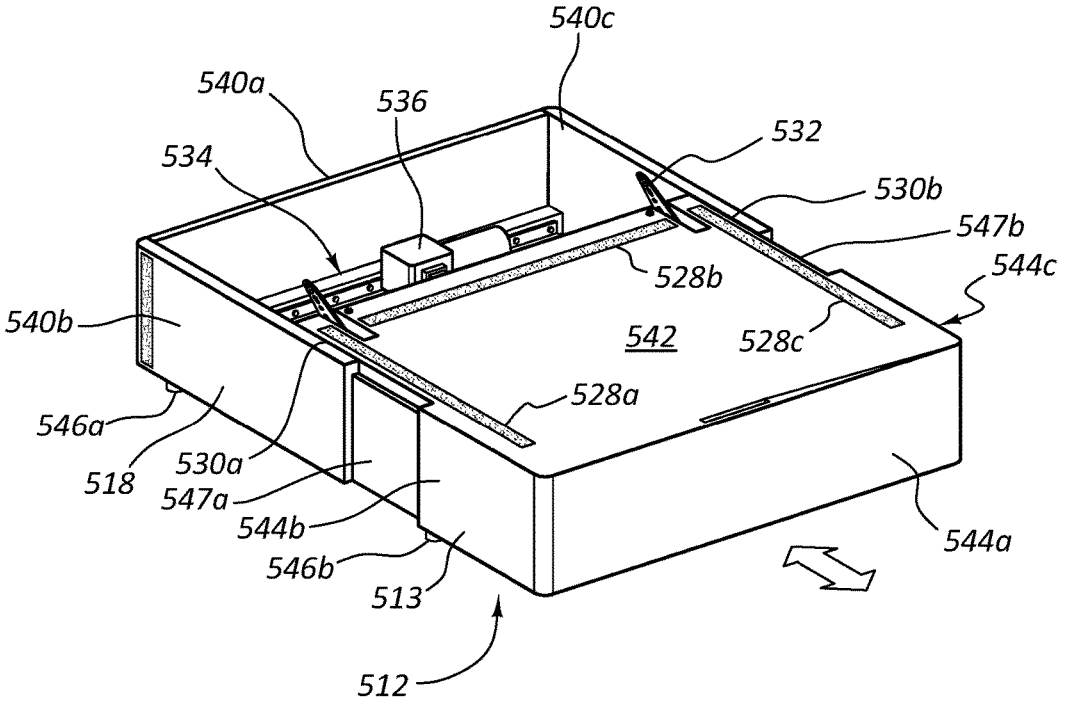
FIG. 4D is a perspective view of the base of FIG. 4C with the brackets of the reclining mechanism moved to the extended, reclined position.

FIG. 4C is a perspective view of the base 512 of the reclining assembly 510 with the backrest 520 removed and with the brackets 532 of the reclining mechanism 534 shown in the non-reclined position. FIG. 4D is a perspective view of the base 512 of FIG. 4C with the brackets 532 of the reclining mechanism 534 moved to the reclined position.

With reference to FIGS. 4C-D, base 512 is comprised of housing 518 and footrest assembly 513, which is moved within housing 518 by reclining mechanism 534.

Housing 518 of base 512 is comprised of three panels 540A-C, which form a U-shaped framework to which recliner mechanism 534 is affixed. The recliner mechanism 534 is also affixed to footrest assembly 513 and selectively moves footrest assembly 513 inwardly and outwardly with respect to housing 518.

Footrest assembly 513 is comprised of (i) a top panel 542 having rear slits for movement of brackets 532; (ii) a front panel 544*a*; and (iii) opposing side panels 544*b* and 544*c*, wherein the front and side panels 544*a-c* extend downwardly from top panel 542 to thereby hide the reclining mechanism 534 from view of a user or others viewing the reclining assembly 510. For example, as shown in FIGS. 1A-1B, the bars and motor of reclining mechanism 534 are generally not visible when viewing reclining assembly 510—in part because of protective panels 544*a-c* extending downwardly at a substantially transverse angle from top panel 542. Panels 542, 544*a-c* may be padded for the user's comfort.

Side panels 544*b-c* slide outside of respective indented panels 547*a-b* extending from respective panels 540*b-c* of housing 518.

Four foot support members 546*a-b* are mounted on the four respective underside corners of housing 518 to maintain base 512 in a stable position on a support surface.

The fixed (non-moving) framework 538 (FIGS. 7A-7B) of reclining mechanism 534 is mounted within the housing 518, as shown in FIG. 4D. A reclining motor 536 is coupled at one end of the motor to the fixed framework 538 and at another end of the motor to the moving framework 568 (FIGS. 7A-B) of recliner mechanism 534, which is connected to footrest assembly 513, to thereby selectively move the footrest assembly 513 outwardly and inwardly, simultaneously moving brackets 532 of reclining mechanism 534 backward and forward.

Figure 5A:
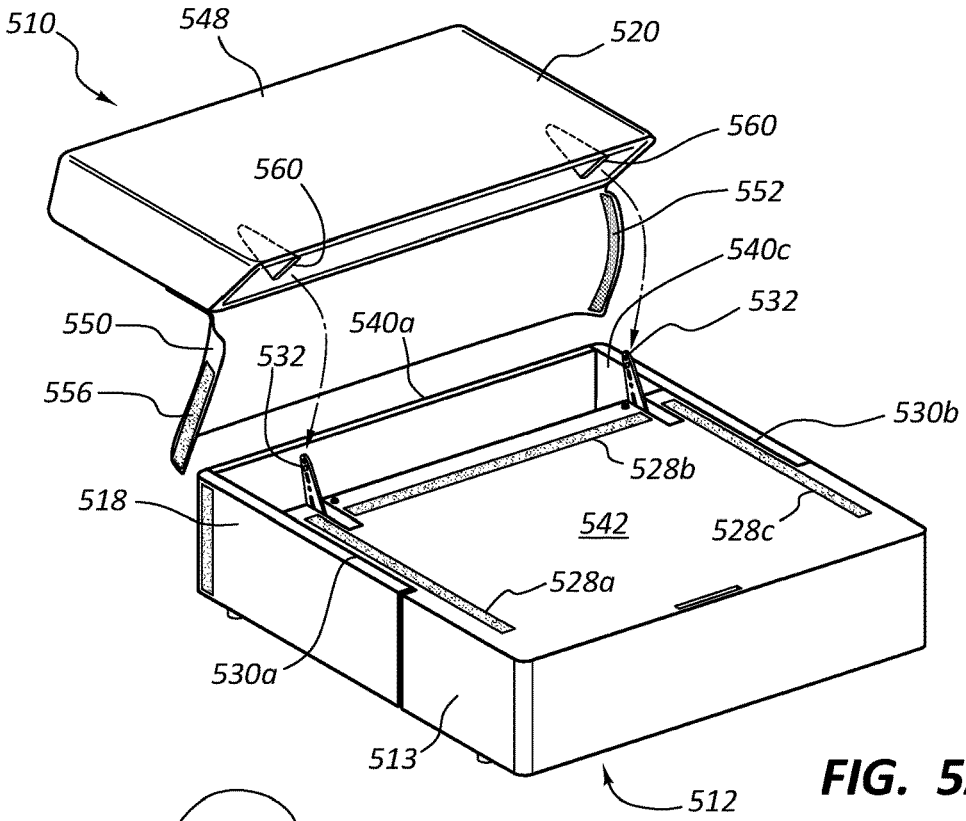
FIG. 5A is an exploded view of the reclining assembly of the present invention, illustrating placement of the backrest onto the reclining mechanism of the base.

FIG. 5A is an exploded view of the reclining assembly 510, illustrating placement of the backrest 520 onto the brackets 532 of reclining mechanism 534 of base 512. Backrest 520 comprises a cushion assembly 548 and receiving members 560 mounted therein. Opposing receiving members 560 housed within the backrest cushion assembly 548 are configured to interlock with respective brackets 532 on opposing sides of base 512 as receiving members 560 are mounted onto brackets 532.

Upon mounting the receiving members 560 of the backrest 520 onto brackets 532, corresponding connection members within receiving members 560 and on brackets 532 snap or lock into each other, fixing the brackets 532 within backrest 520, such as in a spring loaded, detent, and/or other interlocking arrangement.

Figure 5B:
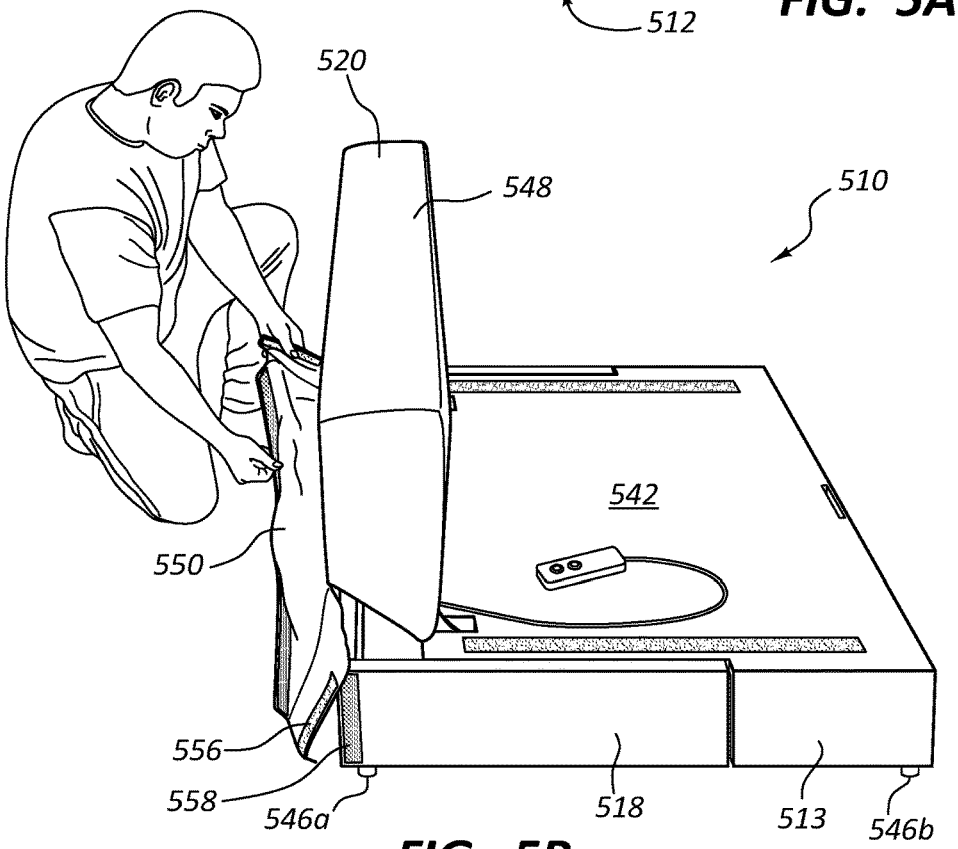
FIG. 5B is a perspective view of the reclining assembly of FIG. 5A, wherein the backrest has been mounted on the reclining mechanism of the base and the skirt of the backrest is being attached to the housing of the framework of the base.

FIG. 5B shows the backrest 520 mounted on the brackets 532 of base 512, and further shows the skirt 550 of backrest 520, which extends from backrest cushion assembly 548, being attached to the housing 518 using two part connection members 552, 558, on respective inside of skirt 550 and outside surfaces of housing 518, such as VELCRO, for example. Connection members 556 of two-part connection members, such as VELCRO can be mounted on the outer surfaces of skirt 550 in order to selectively connect to an outer cover that may be selectively mounted on backrest 520. Skirt 550 thus has connection members on both sides thereof, one set of connection members to attach to housing 518 and another set of connection members to attach to an outer cover (not shown) that is selectively mounted on backrest 520.

In one embodiment, skirt 550 is comprised of a flaccid material that drapes along the back of housing 518 and has hook and/or pile connection members, e.g., VELCRO thereon or other two part connection mechanism, enabling connection of a cover thereto. Cushioning assembly 548 may have one or more cushions therein.

Figure 5C:
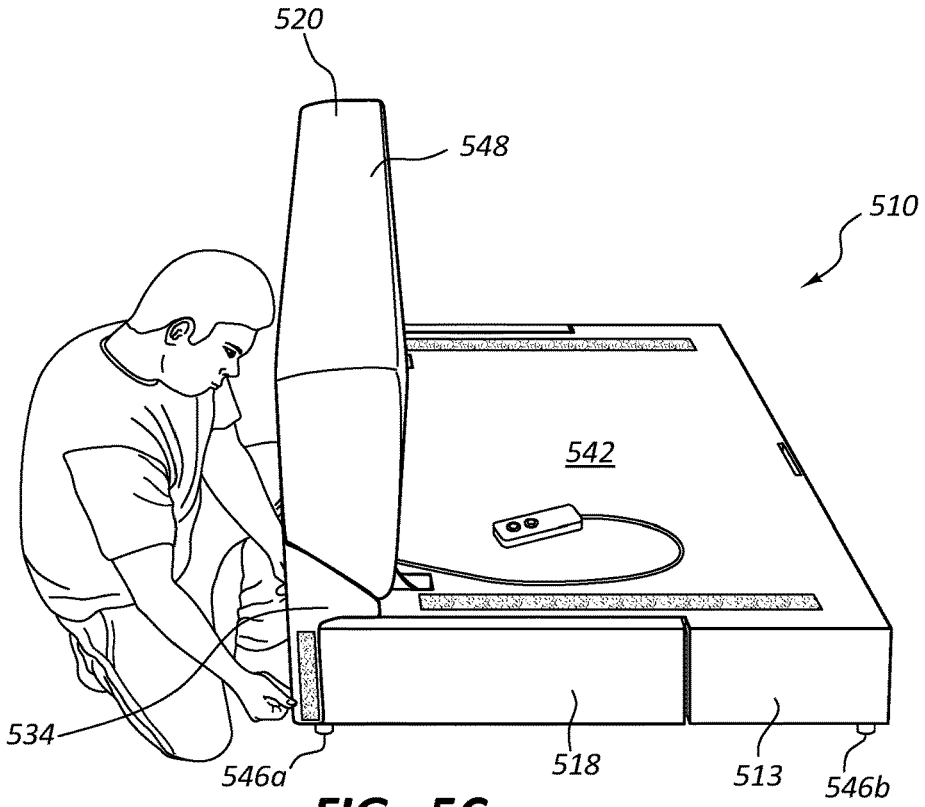
FIG. 5C is a perspective view the reclining assembly of FIGS. 5A and 5B wherein the skirt of the backrest has been attached to the housing of the framework of the base. The reclining assembly is in the compressed, non-extended position.

FIG. 5C shows the reclining assembly 510 wherein the skirt 550 of the backrest 520 has been attached to the housing 518 of the base 518 with assembly 510 in the compressed, non-extended position.

Figure 5D:
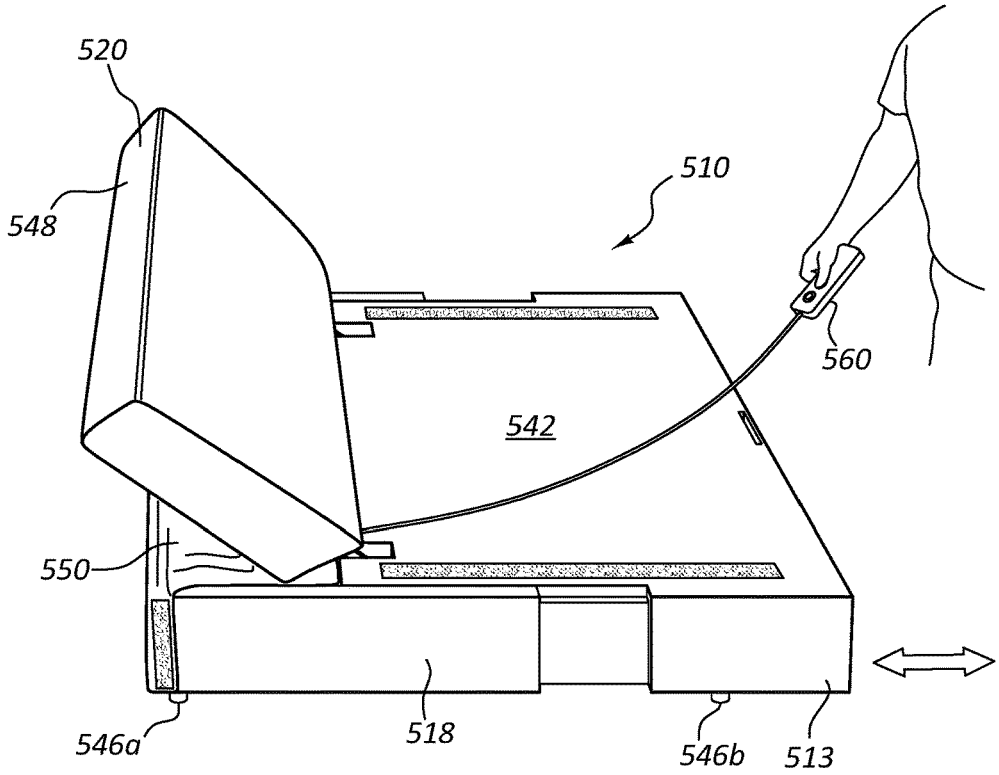
FIG. 5D is a perspective view of the reclining assembly of FIGS. 5A-5C, wherein the reclining assembly is in the extended, reclined position.

FIG. 5D illustrates the selective movement of the reclining assembly 510 back and forth between the extended, reclined position and the compressed, non-reclined position using a wired controller 560, although integral, wireless and software application driven controllers may optionally be employed.

The coupling of reclining assembly modular furniture assembly 10 is shown in FIG. 6. As shown in this figure, one or more and preferably two, couplers 15 are selectively mounted within corresponding slits 62 within base member 12 and within the passageway(s) 530*a-b* of reclining assembly 510. A respective portion of each of base 12 and base 512 are coupled between each of the couplers 15, thereby affixing modular furniture assembly 10 to reclining assembly 510. Foot couplers 34 also selectively couple reclining member 510 to modular furniture assembly 10.

Couplers 15 and the foot couplers 34 and/or or other couplers, may be selectively removed when one desires to remodel or reconfigure the furniture system 500. Also shown in FIG. 6, couplers 15 selectively couple respective transverse members 14 to base 12 and base 510.

FIG. 6 thus demonstrates the selective connection of the reclining assembly 510 of FIG. 1A to the modular furniture assembly 10 of FIG. 1A to form the furniture system of FIG. 1A, the respective seat cushions being shown in an exploded view.

Reclining assembly 510 is conveniently coupled to modular furniture assembly 10 through the use of couplers 15, which can be the same U-shaped couplers used to couple transverse member 14 to base member 12 (see FIGS. 2A-B), for example.

In order to achieve this convenient coupling, one or more couplers 15 are mounted within the passageway 530*a* (between housing 518 and footrest assembly 513) of base 512 of reclining assembly 510 and within a corresponding slit 62 of base 512, as shown in FIG. 6. A transverse member 14 is similarly coupled to base 512 in a similar fashion, e.g., by mounting a coupler 15 within a passageway 530*b* of base 512 and within a corresponding cavity of the transverse member 14.

Thus base 512 has convenient passageways 530*a-b* on first and second side thereof for convenient connections to base 12, transverse member 14 and/or other bases 512 of reclining assemblies 510. One plate of the coupler 15 is placed within a slit of base 12 while the other plate of the coupler 15 is placed within a passageway of base 512, for example. Passageways 130*a-b* between housing 518 and footrest assembly 513 thus enable convenient placement of a coupler such as the coupler 15 in order to selectively couple a modular furniture assembly 10 to a recliner assembly 510.

The recliner assembly 510 may also be selectively coupled to modular furniture assembly 10 through the use of one or more foot couplers 34 as shown in FIG. 1A, coupling a corresponding foot of the recliner assembly 510 to a corresponding foot of a base 12 or transverse member 14 of a modular furniture assembly 10.

Figure 6A:
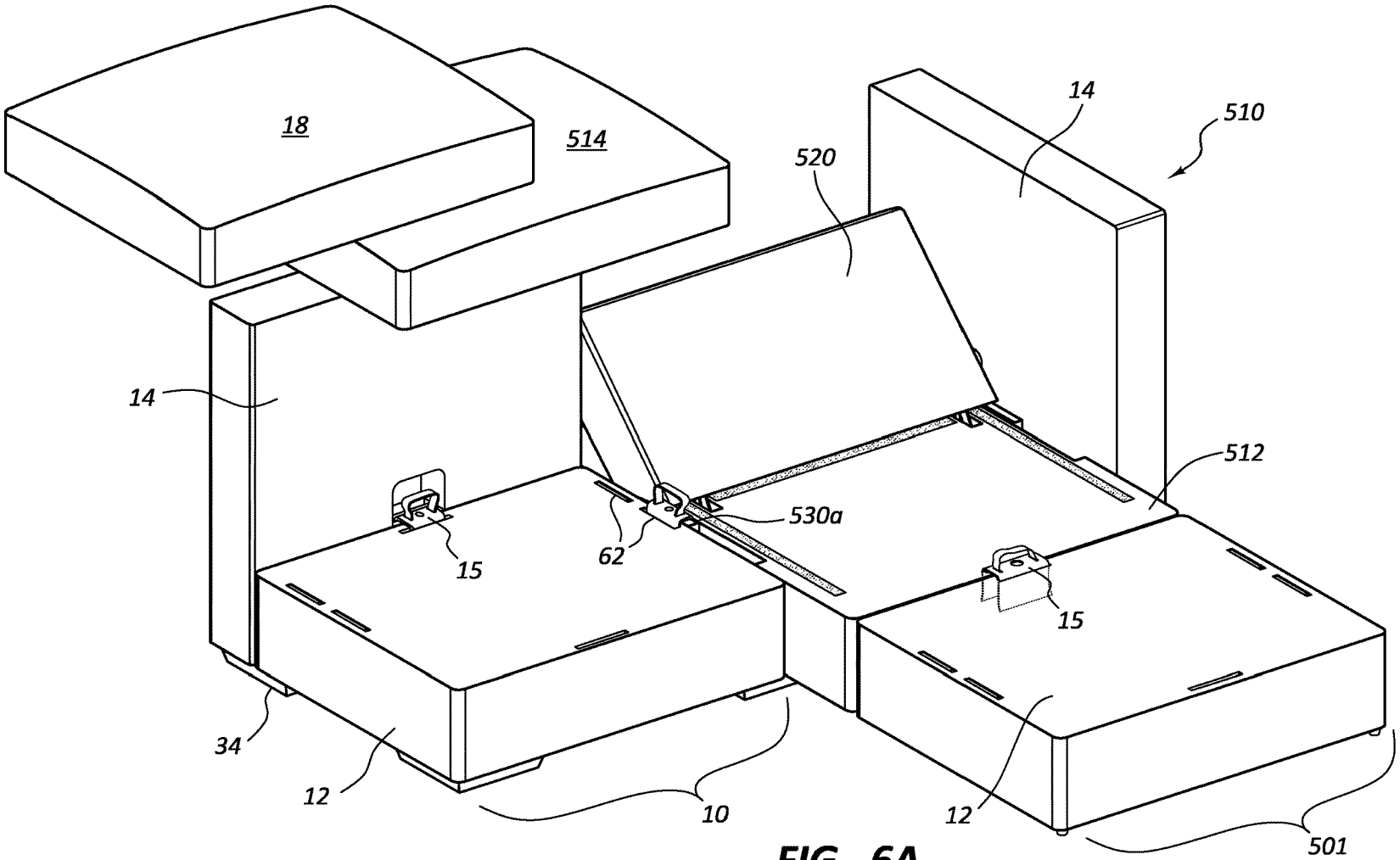
FIG. 6A demonstrates the reclining assembly of FIG. 6 in a reclined position and further shows the connection of a base 12 to the reclining assembly of FIGS. 1A and 6A through the use of a U coupler.

FIG. 6A demonstrates the connection of the front end 599 (FIG. 6) of the reclining assembly of FIGS. 1A and 6A to another base 12 through the use of a U coupler 15, and shows the reclining assembly 510 in an extended position. As shown in FIG. 6A, it is possible to effectively lengthen the base 512 of the reclining assembly 510 by selectively coupling an additional base 12 to the front 599 of the base 512, e.g., through the use of a U-coupler 15 as shown in FIG. 6A.

In the embodiment of FIG. 6A, when the footrest assembly 513 of base 512 is moved outwardly to the extended position, it pushes the additional base 12 mounted on the front 599 thereof. Similarly, when the footrest assembly 513 of base 512 is retracted back to the retracted postion, the additional base 12 moves to the retracted position with the base 512. Thus, the additional base 12 of FIG. 6A effectively lengthens the base 512 of reclining assembly 510 and the additional base 12 of FIG. 6A moves back and forth with base 512 as base 512 moves between the reclined and non-reclined positions.

Figure 10A:
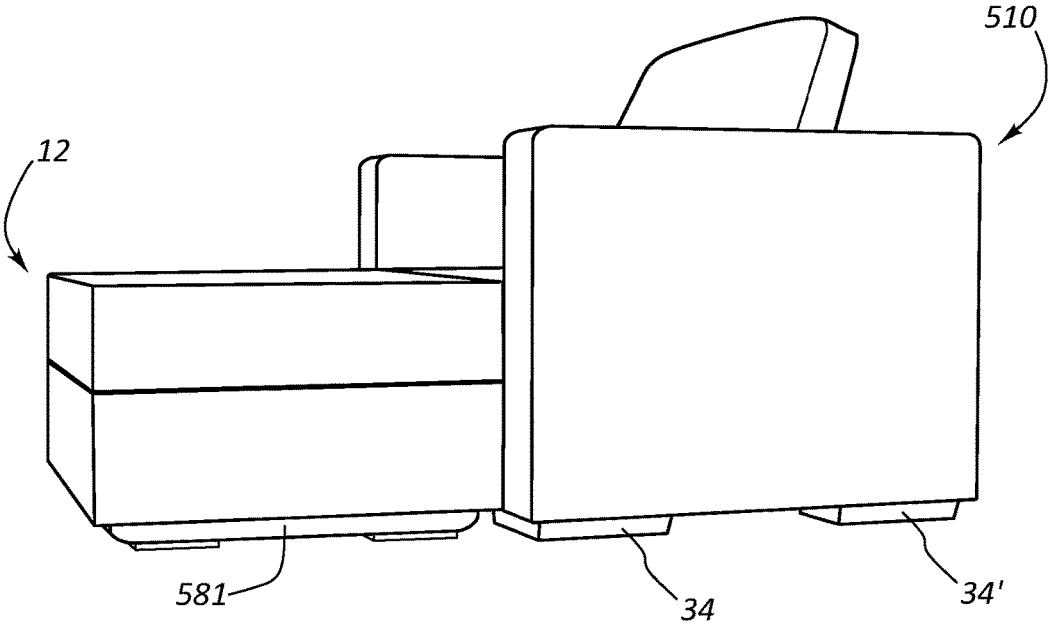
FIGS. 10A-10C are perspective views of a reclining assembly similar to those above, but including an additional base mountable to the front end of the footrest assembly of the reclining assembly, with one or more sled rails mounted on an underside of the additional base.
Figure 10B:
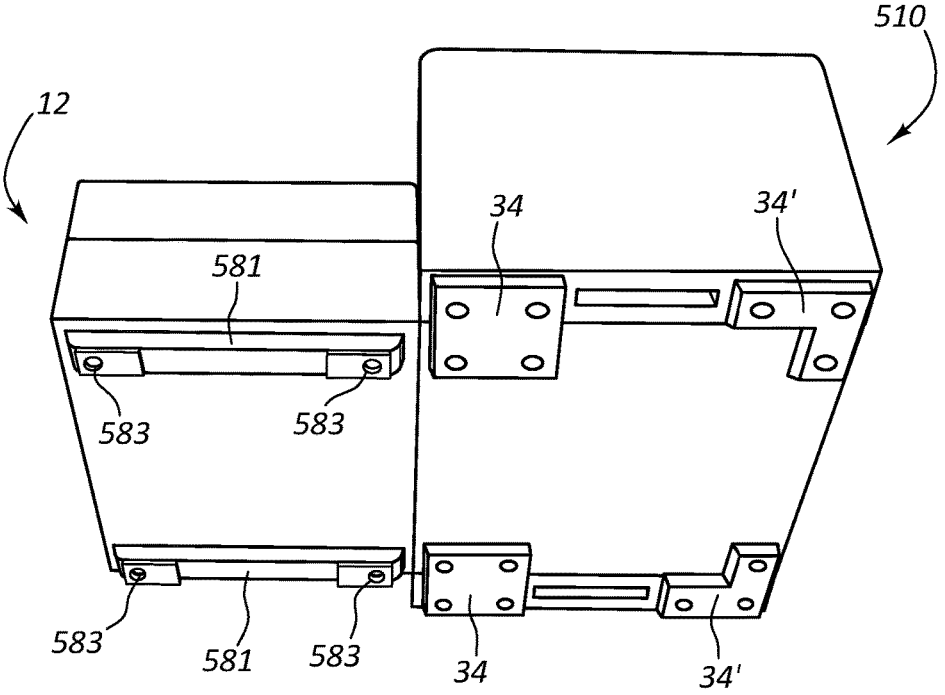
Figure 10C:
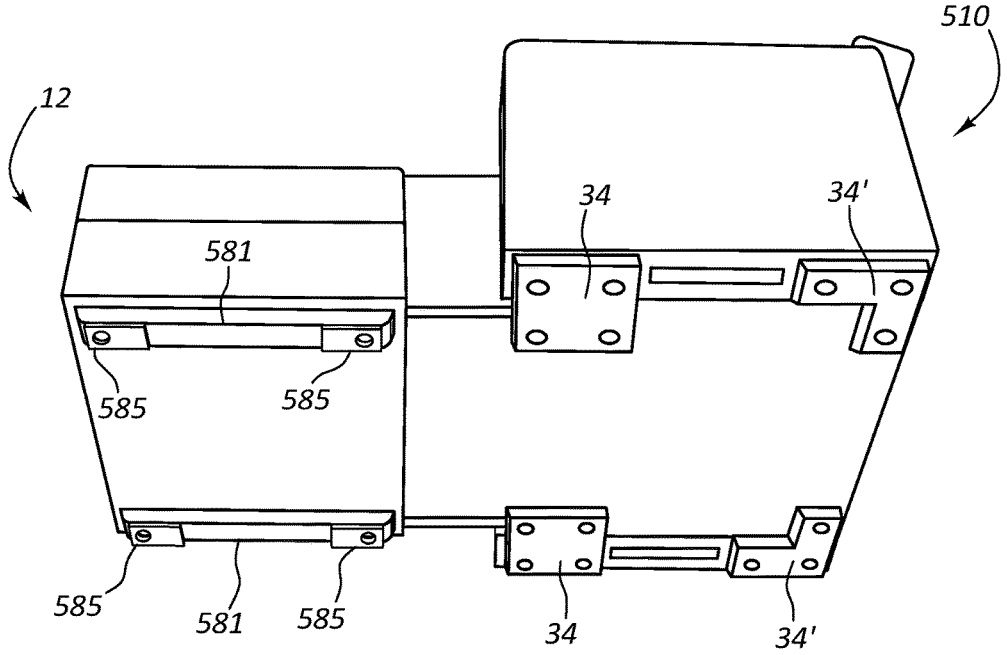

In one embodiment, the additional base 12 mounted to the front of footrest 513 slides back and forth on the front and/or rear feet thereof, or optionally, can move on rollers or casters or similar devices. In one embodiment, the front and/or rear feet of the additional base 12 of FIG. 6 have felt or plastic thereon for sliding on a respective surface and/or may be mounted within foot couplers that have felt or plastic thereon for sliding on a respective surface. In one embodiment, foot couplers 34 are mounted on the front and/or rear feet of the additional base 12. Such foot couplers 34 can assist in coupling the additional base 12 to base 512 and can move when the additional base 512 moves, for example. As shown in FIGS. 10A-10C, sled rails 581 could alternatively be provided.

A method for forming the furniture system of FIG. 6A thus further comprises placing an additional base 12 adjacent the front 599 of a footrest assembly 513 of the reclining assembly 510 and coupling the additional base 12 to the footrest assembly 513, as illustrated in FIG. 6A, the additional base 12 moving when the base 512 of the reclining assembly moves.

FIG. 6A further shows how coupler 15 remains stationary relative to the base 12 of furniture assembly 10 on the left side of FIG. 6A, while coupling said base 12 to base 512 of reclining assembly 510. While coupler 15 remains stationary relative to such base 12 and relative to housing 518 of base 512, there is relative movement by footrest assembly 513 with respect to base 12, housing 518, and coupler 15. Thus the mounting of couplers 15 within respective slots 530*a*, 530*b* effectively maintains base 12 coupled to housing 518 while still allowing movement of footrest assembly 513.

Figure 7A:
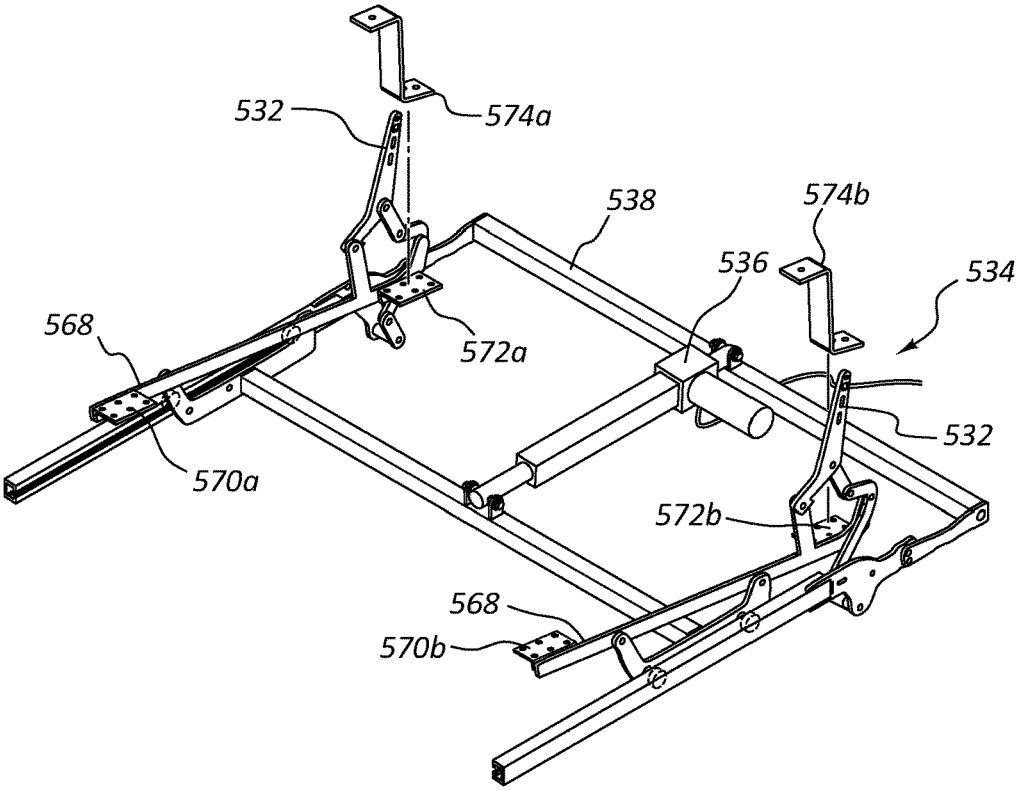
FIGS. 7A and 7B show respective perspective views of an example of a recliner mechanism of the present invention, showing the recliner mechanism in a compressed, non-reclined position in FIG. 7A and an extended, reclined position in FIG. 7B.
Figure 7B:
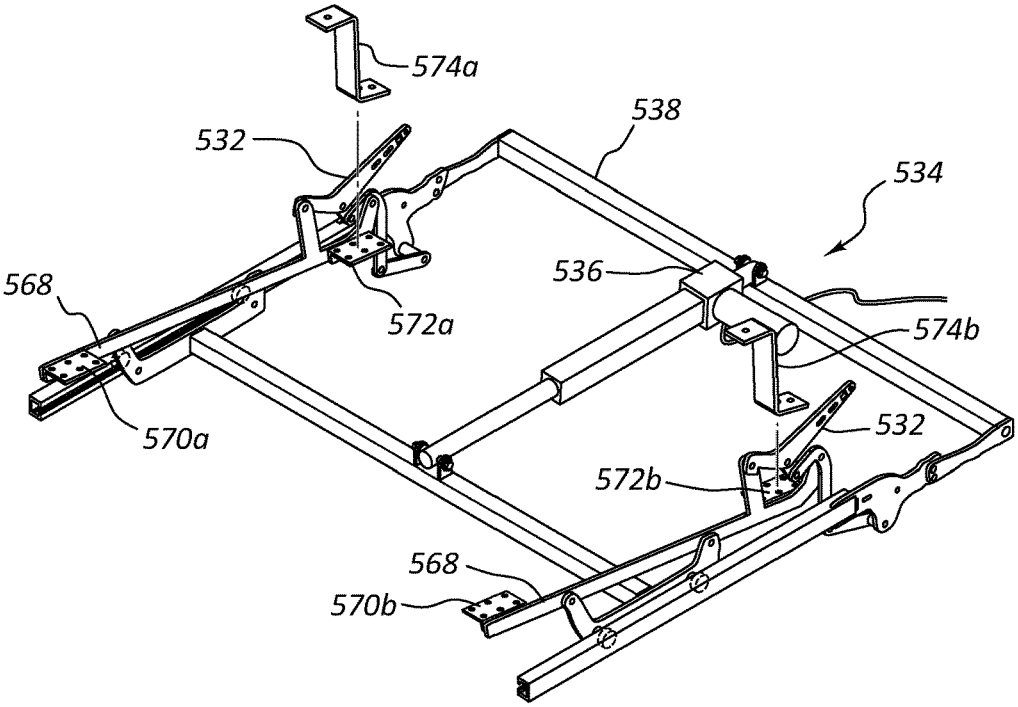

FIGS. 7A and 7B show respective perspective views of an example of a recliner mechanism 534 of the present invention, showing the recliner mechanism 534in a compressed, non-reclined position in FIG. 7A and an extended, reclined position in FIG. 7B.

Recliner mechanism 534 is comprised of (i) a fixed (non-moving) framework 538 that is affixedly mounted within the housing 518; (ii) a moving framework 568 that is movably coupled to the fixed framework; and (iii) a reclining motor that is coupled to the moving framework 568 and the nonmoving framework 538 and that selectively moves the moving framework 568 with respect to the non-moving framework 538. The moving framework includes brackets 532 which couple to the backrest 520.

The nonmoving framework mounted within housing 518 is comprised of a rail assembly upon which a portion of the moving framework moves, e.g., through rolling or sliding, wherein the extension motor 536 selectively moves the moving framework along the rail assembly.

The moving framework 568 includes a pair of rail members that moves outwardly when the moving framework 568 is pressed by the extension motor 536. Upon such movement, upright bracket members 532 each pivot backwards, reclining the backrest member 520. Thus, the reclining mechanism 534, selectively slides footrest assembly 513 back and forth with respect to housing 518 and simultaneously reclines and inclines backrest 520.

Front attachment members 570*a-b* of the moving framework 568 attach to the upper panel 542 of base 512, while rear attachment members 572*a-b* attach to the upper panel 542 through the use of respective brackets 574*a-b* mounted between members 572*a-b* and panel 548.

In one embodiment, assembly 534 is conveniently hidden or at least substantially hidden in use behind panels 544*a-c*. Thus, an advantage of one embodiment of reclining assembly 510, as shown in the FIGS. 1B, 3B, 4B, and 5B is that moveable footrest assembly 513 extends outwardly from housing 518 in a manner that the reclining mechanism 534 is not seen or is substantially not seen from the sides or from the front of assembly 510. Thus, the outwardly moving footrest assembly 513 appears in the extended position as a natural piece of furniture, as if it had not been reclined, as opposed to a mechanized plate that is common in typical recliners. This extended footrest assembly 513 is more aesthetically pleasing than the view of the footrest of a typical mechanized recliner, which often does not hide the reclining mechanism.

Furthermore, the recliner mechanism 534 is oriented within housing 518 so as to selectively move the footrest assembly 513 respect to housing 518 and to move backrest 520 wherein the entire assembly 510 remains within the x"=x'" footprint in the compressed non-extended position while at least a portion of the footrest assembly is configured to move outside of the x"=x'" footprint in the extended, reclined position.

Thus, as shown in FIG. 1A, when recliner assembly 510 is in the compressed position, the furniture system 10 appears similar to a typical non-recliner couch or sofa system. However, when moved to the extended, reclined position of FIG. 1B, the system 10 is conveniently comfortable for a reclining individual.

Recliner mechanism 534 may be a variety of different commercially available reclining mechanisms, such as reclining mechanisms available from Leggett and Platt, 1 Leggett Road, Carthage, Mo., 64836, U.S.A., (website: homefurniturecomponents.com), such as reclining mechanisms available in INSPIRA branded furniture or other wall-hugging reclining mechanisms from Leggett and Platt, 1 Leggett Road, Carthage, Mo., 64836, U.S.A., for example, or a variety of other commercially available recliner mechanisms, for example.

Figure 8:
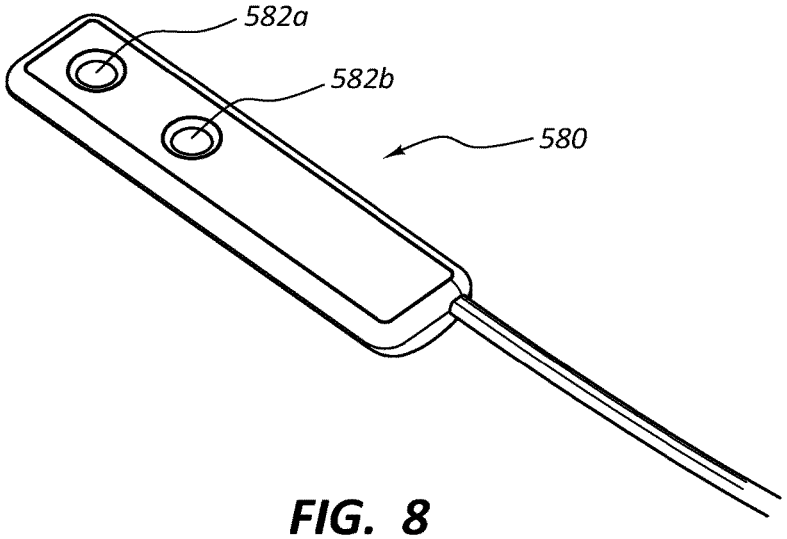
FIG. 8 demonstrates an example of a hand-held controller assembly of the present invention having a wired connection to the motor of the reclining mechanism.

FIG. 8 demonstrates an example of a hand-held controller assembly 580 of the present invention. In one embodiment as shown in FIG. 8, the reclining of the reclining assembly 510 is controlled by a hand-held controller assembly 580 controlled by touch control buttons 582*a-b*, the controller assembly 580 being electrically linked by an electrical cord (or wirelessly) to the motor 536 of the reclining mechanism 534.

Figure 9A:
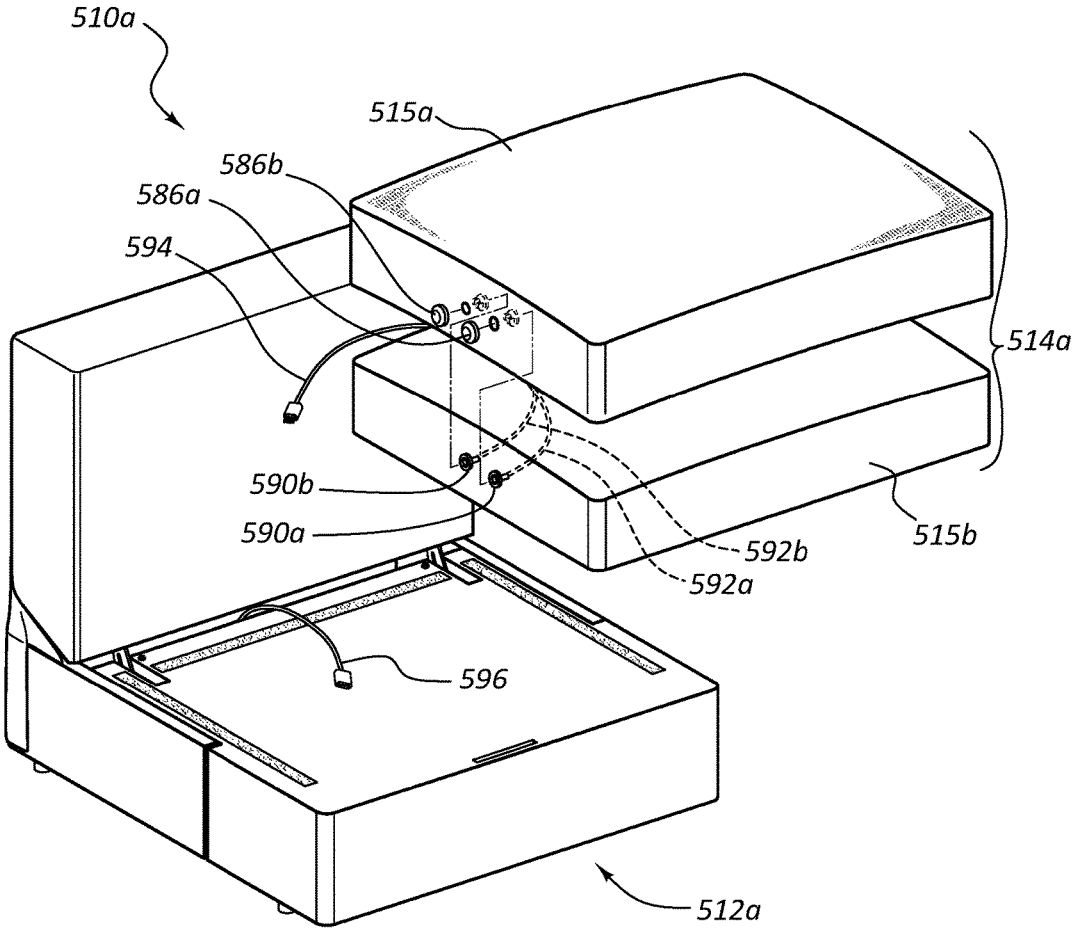
FIGS. 9A-B demonstrate an example of an alternative reclining controller in the form of a touch control controller assembly comprising touch control buttons mounted on a seat cushion of the reclining assembly.
Figure 9B:
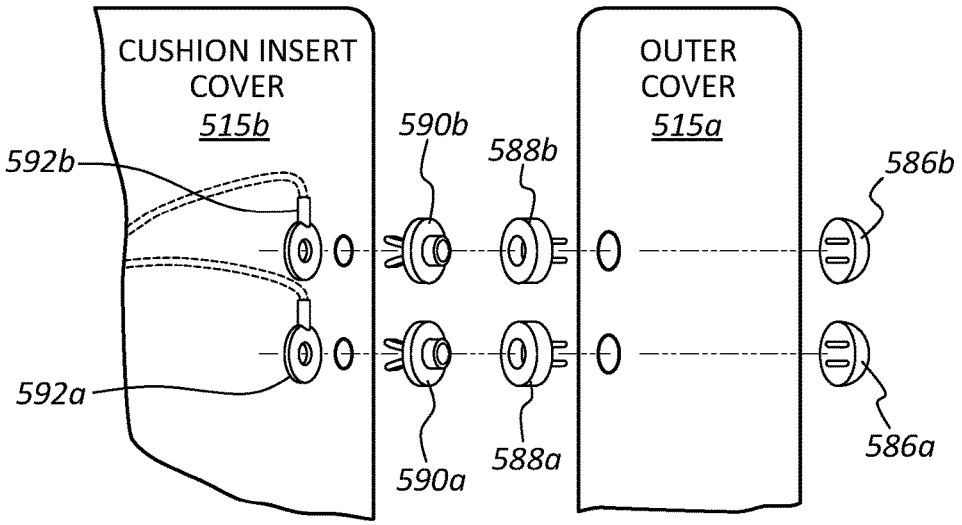

FIGS. 9A-B demonstrate an alternate example of an alternate reclining controller assembly in the form of a touch control controller assembly mounted on a seat cushion. The reclining control assembly of FIGS. 9A-9B comprises outer cover buttons 586*a-b*; corresponding inner cover buttons 588*a-b*; and corresponding outer cushion insert buttons 592*a-b*, which connect to each other as illustrated and which are electrically coupled to the reclining mechanism of reclining assembly 510*a*.

The reclining control assembly comprises touch control buttons 586*a-b* mounted on the side of the seat cushion 514 of reclining assembly 510*a*, the control buttons 586*a-b* being electrically linked by an electrical cord (or optionally, wirelessly) to the motor 536 of the reclining mechanism 534.

One button, e.g., button 586*a*, reclines the reclining assembly 510*a* while the other button, e.g., button 586*b*, returns the reclining assembly 510*a* to the non-reclined position. Touch control buttons 586*a-b*, which may be inductive touch control buttons, for example, use impulses received from the touch of a user's finger to control the amount of reclining performed by reclining mechanism 534. Using the touch control buttons 586*a-b*, the user can selectively recline and incline the reclining assembly 510*a*.

Cushion 514 is comprised of an outer cover 515*a* and an inner cushion insert 514*b*. Outer cushion cover 515*a* is selectively mounted on inner cushion insert 514*b*. Inner cushion insert 515*b* comprises, in one embodiment, a cushioning (e.g., foam) material covered by a thin insert cover.

Outer cover buttons 586*a-b* may attach to respective inner cover buttons 588*a-b* in a variety of different manners, such as mechanically, magnetically, friction fit, adhesives, integral connection, or a variety of different attachment methods. In one embodiment, for example, the prongs of inner cover buttons 588*a-b* are moved into the grooves of respective outer cover buttons 586*a-b* and bent within the spaces defined by the grooves of respective outer cover buttons 586*a-b* (e.g., within the cavity inside the dome—shaped cover buttons 586*a-b*) to thereby affix respective buttons inner and outer cover buttons to each other with the cover there-between.

Outer touch control buttons 586*a-b* are coupled on the outside of the outer cover 515*a* of cushion 514 for contact by a user. Buttons 586*a-b* attach via attachment members extending through the fabric of the outer cover 515*a* to corresponding inner cover buttons 588*a-b*, as shown in FIGS. 9A-9B.

Once the outer cover 515*a* is correspondingly mounted on the cushion insert 515*b* (which contains cushioning material covered by a thin cover), the inner cover buttons 588*a-b* are in physical and magnetic contact with corresponding cushion insert outer buttons 590*a-b*. Buttons 588*a-b* thus magnetically connect to corresponding buttons 590*a-b*.

Cushion insert outer buttons 588*a-b* are on the outside of cushion insert 515*b* electrically coupled to wires 592*a-b* which electrically couple via wiring bundle 594 to a corresponding wiring connection 596 on the base 512*a* of the reclining assembly 510*a*, which is electrically linked to the motor 536 of the reclining mechanism 534.

Thus, when the outer cover 515*a* is correspondingly mounted on the cushion insert 515*b*, the inner cover buttons 588*a-b* are in physical and magnetic contact with corresponding cushion insert outer buttons 590*a-b* such that outer cover buttons 586*a-b* can be touched by the user to control the reclining of the reclining assembly 510*a*.

The outer cover 515*a* having outer touch buttons 586*a-b* and corresponding inner buttons 588*a-b* can be selectively, magneticaly mounted onto cushion insert 515*b* and can be selectively removed from cushion insert 515*b*. Thus, removable outer cover 515*a* can be removed from insert 515*b* and washed independently and/or replaced with a new outer cover 515*a* having the same configuration and buttons with a different color or fabric, etc. Buttons 586*a-b* and attached buttons 588*a-b* of removable cover 515*a* electrically couple to outer buttons 590*a-b* of insert 515*b* when cover 515*a* is selectively mounted thereon.

Washable, removable outer cover 515*a* is thus selectively mounted on insert 515*b* and has touch control buttons 586*a-b* mounted thereon for convenient reclining of recliner assembly 510*a*. In one embodiment, recliner assembly 510*a* can be configured with the same elements, configurations, and specifications as the recliner assembly 510 of FIGS. 1-7, plus the additions of the control buttons of FIGS. 9A-B.

FIGS. 10A-10C illustrate how one or more sled rails 581 can be provided on an underside of additional base 12 mounted to front end 599 of base 512 of the reclining assembly 510. For example, such sled rails are helpful as when base 512 advances to the reclined position (advancing forward), additional base 12 slides over the floor on which the reclining assembly 510 is supported.

Similar to foot couplers 34, 34', sled rails 581 include holes 583 formed therethrough, sized for reception of a foot of additional base 512 therein, serving to couple sled rails 581 to additional base 512. In FIG. 10B, the internal recliner mechanism (e.g., of FIGS. 7A-7B) is purposely omitted, to better show foot couplers 34, 34' and sled rails 581. Because of the integral configuration of the base and backrest associated with reclining 510, L-shaped foot couplers 34' are shown (rather than rectangular foot couplers 34), coupling the base of the reclining assembly 510 to transverse members disposed on each side thereof.

Figure 11A:
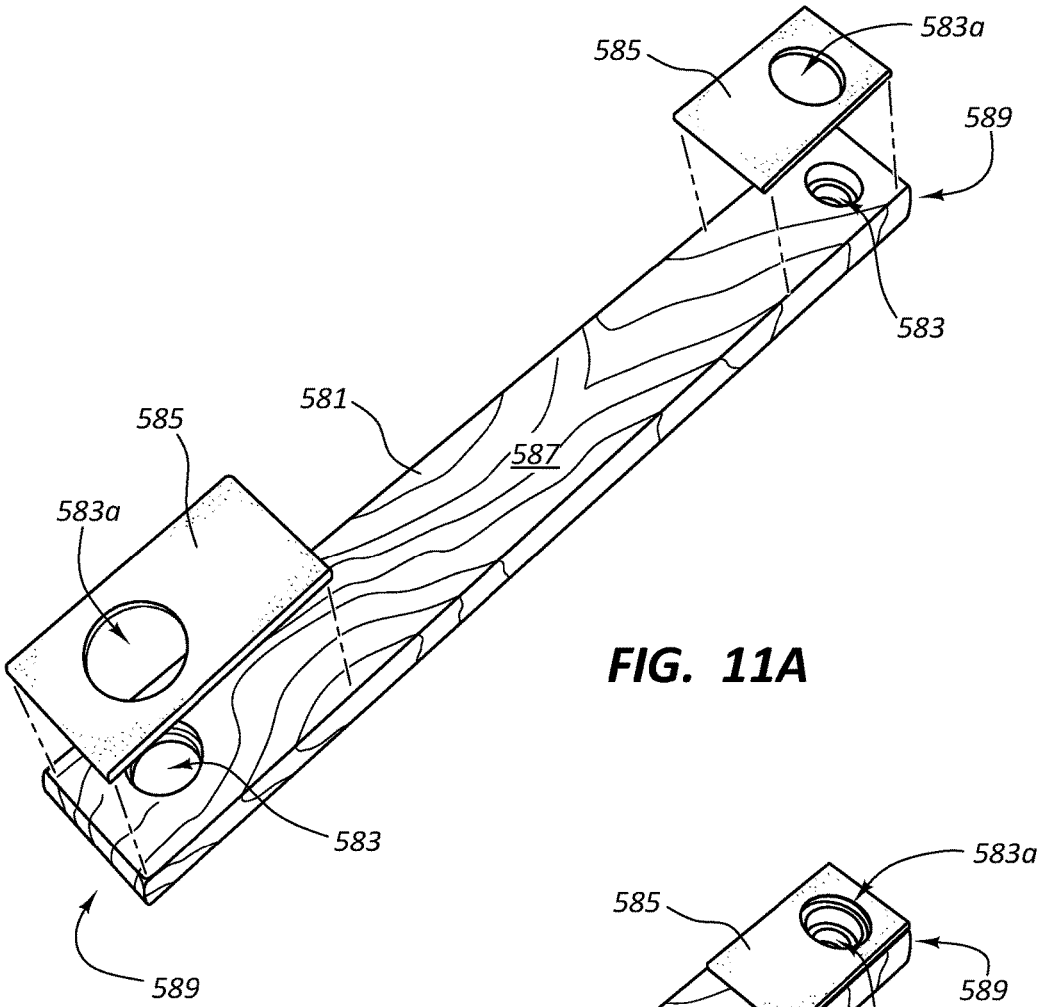
FIGS. 11A-11D show sled rails such as those mounted on the underside of the additional base of the reclining assembly of FIGS. 10A-10C.
Figure 11B:
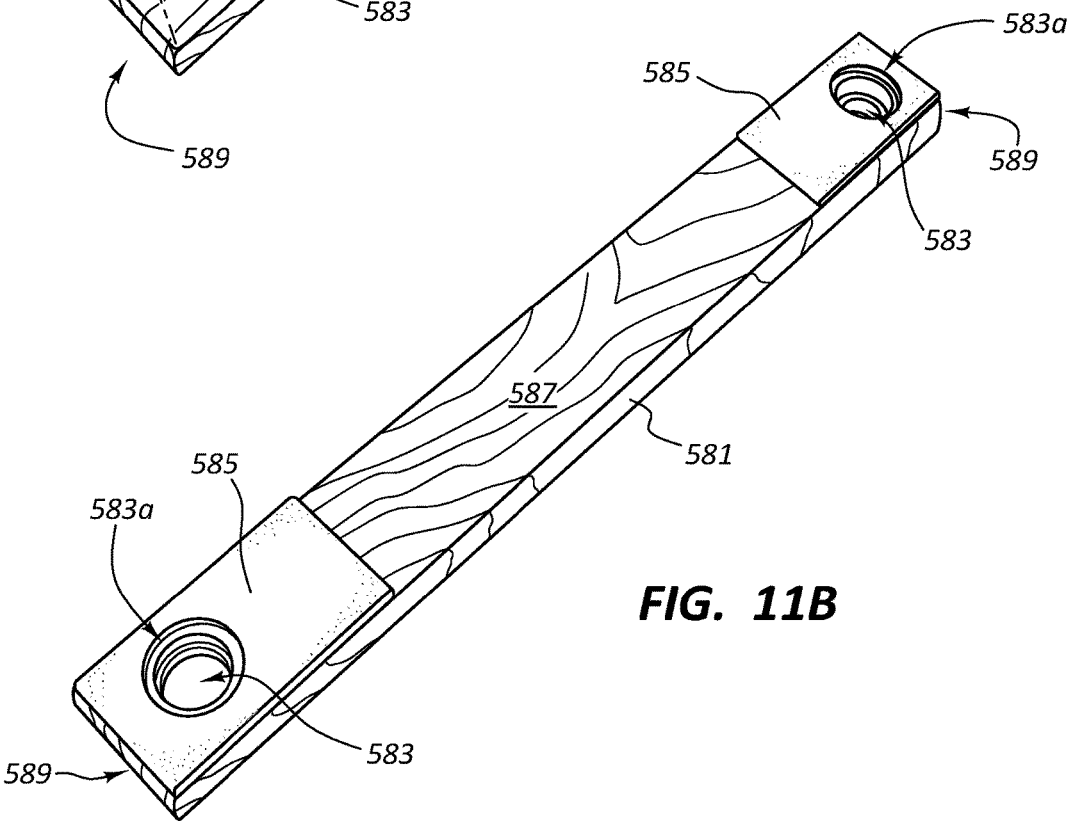

FIGS. 11A-11B illustrate sled rails 581 separate from additional base 512. Each sled rail is elongate in shape, and is shown as including a felt shoe 585 mountable over each hole 583 adjacent the opposed ends of sled rail 581. As shown in FIGS. 11A and 11B, each felt shoe 585 is shown as further including a hole 583*a*, which becomes aligned with hole 583 of sled rail 581 when felt shoe 585 is positioned over the corresponding end of sled rail 581, as shown in FIG. 11B. Such a hole 583*a* permits a foot of additional base 12 to be received into hole 583 of sled rail 581, and to further be received into hole 583*a*.

Each sled rail 581 is elongate in shape, having a length that is greater than shoes 34, as shown in FIGS. 10A-10B. Further as shown in FIGS. 10A-10B, sled rail 581 is narrower in width than shoe 34. For example, in an embodiment, the width of rail 581 is about 40% to about 60% that of shoe 34. FIG. 10B shows rail 581 placed parallel with the width y of additional base 12. The length of rail 581 is shown as being nearly equal to width y (e.g., at least about 80% thereof, at least 85% thereof, or at least about 90% thereof). Rail 581 is shown as including only a single hole in each end, rather than the two holes provided in each end of shoes 34 (which dual holes can be used to couple a base to a transverse member).

Figure 11C:
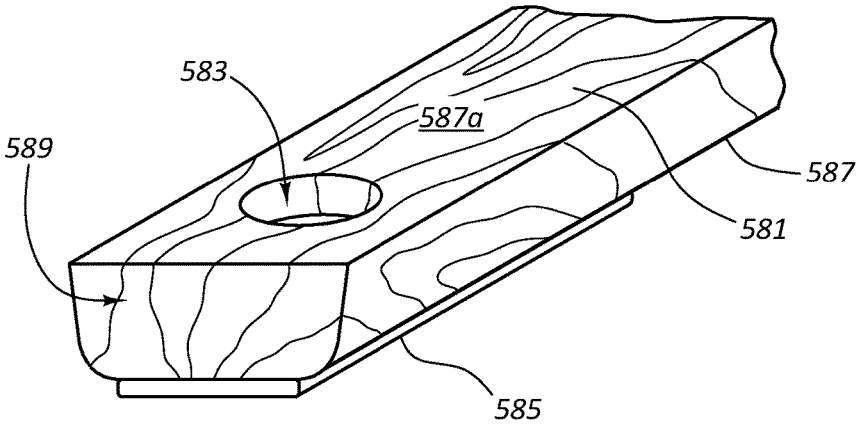
Figure 11D:
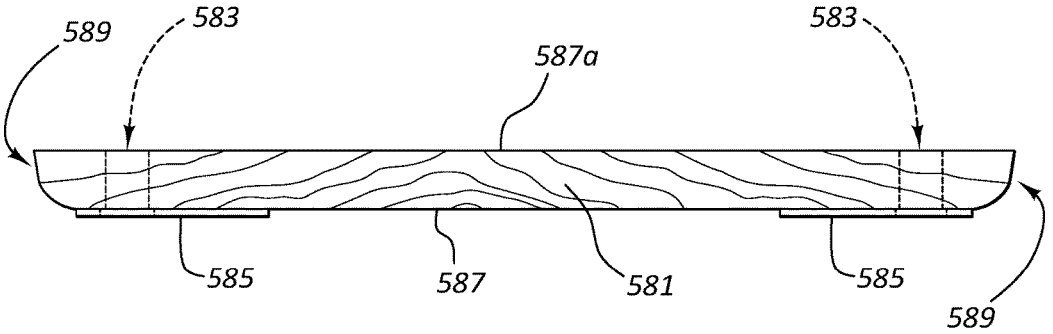

As shown in FIG. 11C-11D, sled rails 581 are shown tapered to be narrower adjacent bottom face 587 as compared to the opposite top face 587*a*. In addition, the ends 589 are shown as including a curved outer edge adjacent the bottom face 587 of each sled rail 581, which facilitates better sliding of sled rail 581, as it slides across the floor (e.g., whether carpeted, hardwood, tile, or the like). The illustrated felt shoes 585 may be optional, e.g., allowing the user to decide whether to mount them over holes 583. For example, if used on a hardwood, tile, or similar hard surface floor, the felt shoes may be desired. If used on carpet, a rug, or similar relatively soft surface floor, the user may prefer to omit the felt shoes.

For example, the felt shoes 585 provided with sled rails 581 can be provided with a pressure sensitive or other adhesive preapplied to the shoes 585, allowing the user to simply peel away a backing layer, exposing the adhesive, and then applying them, if use of the shoes is desired. Of course, other mechanisms (e.g., hook and loop fastener, or the like) for mounting felt shoes 585 could be used.

As will be appreciated from FIG. 6A, additional base 12 is attached to base 512 at a top portion of both bases, using coupler 15. As shown in FIG. 10B, rather than coupling a lower portion of additional base 12 to base 512 using foot couplers 34, the lower portion of additional base 12 is shown as uncoupled to base 512, although it will be appreciated that in an alternative configuration, a lower coupling could be provided.

It will be appreciated from FIG. 6A that coupler 15 in passageway 530*a* that couples base 512 to an adjacent modular furniture assembly 10 remains in a stationary position when footrest assembly 513 of reclining assembly 510 moves back and forth between the extended and non-extended positions. On the other hand, coupler 15 seen in FIG. 6A that couples front end 599 of base 512 to additional base 12 moves when the footrest assembly of the reclining assembly 510 moves back and forth between the extended and non-extended positions, as bases 12 and 512 move together. FIG. 10C shows the reclining assembly 510 in the extended position, while FIG. 10A shows the reclining assembly 510 in the non-extended position.

A method for mounting a reclining assembly 510 adjacent a modular furniture assembly 10 includes providing a modular furniture assembly with a reclining assembly 510, providing a first coupler 15 to be placed within the modular furniture assembly 10 and the reclining assembly 510, and providing a second coupler to be placed within the reclining assembly 510 and the additional base 12. The modular furniture assembly 10 is placed adjacent the reclining assembly 510, and additional base 12 is placed adjacent reclining assembly 510. The first coupler is mounted within the modular furniture assembly 10 and the reclining assembly 510, coupling them to one another (e.g., see coupler 15 in passageway 530*a* in FIG. 6A). The second coupler is mounted within the recliner assembly 510 and the additional base 12, coupling them to one another (see coupler 15 coupling base 12 to base 512).

As described above and perhaps best seen in FIG. 6A, the modular furniture assembly 10 and the reclining assembly 510 include a slit and passageway, respectively. The first coupler 12 is configured to be selectively mounted within slit 62 and passageway 530*a*, coupling base 12 to base 512, as seen in FIG. 6. As seen in FIG. 6A, the reclining assembly (e.g., base 512) includes a slit adjacent front end 599 into which coupler 15 is inserted, with coupler 15 also being inserted into a corresponding slit of additional base 12 positioned in front of base 512.

While FIGS. 10A-10C illustrate a configuration in which the sled rails are mounted on additional base 12, which is separate from the base 512 (or footrest assembly 513 of FIG. 1A), it will be appreciated that in an embodiment, the sled rails can be provided on base 512. In one such example, base 512 could even be oversized relative to other bases 12 (e.g., having dimensions substantially equivalent to coupled base 512 and additional base 12 seen in FIGS. 10A-10C). In other words, instead of two separate bases, a single unitary oversized base could be provided, with slide rails. In another embodiment, base 512 could be the "normal" size as illustrated, but include slide rails thereon. An oversized base could have a length of 2x, rather than x, or a fractional multiple of x, greater than 1x (e.g., 1.5x, or 1.75x).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A furniture system, comprising:

a modular furniture assembly having footprint specifications which identify the footprint of the modular furniture assembly, the modular furniture assembly comprising a base and a transverse member that can be selectively coupled to each other; and a reclining assembly configured to be selectively coupled to the modular furniture assembly, wherein the reclining assembly is configured to be mounted adjacent to the modular furniture assembly such that the reclining assembly can be selectively coupled to the modular furniture assembly to form a convenient, useful, and aesthetically pleasing sofa, wherein, in a compressed, non-reclined position, the reclining assembly has substantially the same footprint specifications as the footprint specifications of the modular furniture assembly;

wherein the reclining assembly includes (i) a housing; (ii) a footrest assembly; and (iii) a recliner mechanism configured to selectively move the footrest assembly with respect to the housing, an additional base mountable to a front end of the footrest assembly of the reclining assembly, the additional base moving when the base of the reclining assembly moves, wherein the additional base includes at least one sled rail mounted on an underside of the additional base.

2. A furniture system as recited in claim 1, wherein the additional base includes two sled rails mounted on the underside of the additional base.

3. A furniture system as recited in claim 2, wherein the sled rails are elongate in shape, and are mounted on the underside of the additional base at opposed sides thereof.

4. A furniture system as recited in claim 1, further comprising at least one felt shoe mounted or mountable to an underside of the at least one sled rail, between the sled rail and a floor surface on which the additional base is supported.

5. A furniture system as recited in claim 1, wherein the at least one sled rail includes a hole at each opposed end of the sled rail, the holes being configured to receive a foot of the additional base, coupling the sled rail to the additional base.

6. A furniture system as recited in claim 5, further comprising at least one felt shoe mounted or mountable to an underside of the at least one sled rail, between the sled rail and a floor surface on which the additional base is supported, wherein the felt shoe includes a hole that is aligned with one of the holes of the sled rail, such that the foot of the additional base is configured to pass through the hole of the sled rail and the hole of the felt shoe.

7. A furniture system as recited in claim 1, wherein the at least one sled rail is tapered so as to be narrower adjacent a bottom face thereof as compared to a top face thereof.

8. A furniture system as recited in claim 7, wherein the tapering includes a curved outer edge adjacent the bottom face of the sled rail.

9. A furniture system as recited in claim 1, wherein a passageway extends between the housing and the footrest assembly such that a coupler is selectively mountable within the passageway and within a corresponding slit of the modular furniture assembly, so as to couple the housing of the recliner assembly to the modular furniture assembly.

10. A furniture system as recited in claim 9, wherein a U-shaped coupler selectively couples the reclining assembly to the modular furniture assembly upon insertion into the passageway and the slit.

11. A furniture system as recited in claim 1, wherein a first coupler selectively couples the reclining assembly to the modular furniture assembly, the first coupler being configured to remain in a stationary position when the footrest assembly of the reclining assembly moves back and forth between extended and non-extended positions, and wherein a second coupler selectively couples the additional base to the reclining assembly, the second coupling being configured to move when the footrest assembly of the reclining assembly moves back and forth between extended and non-extended positions.

12. A furniture system as recited in claim 11, wherein the first and second couplers are U-shaped couplers that are substantially identical to one another.

13. A furniture system as recited in claim 1, further comprising a controller assembly at least partially mounted on a removable cover of a cushion of the recliner assembly and electrically linked to the reclining mechanism.

14. A furniture assembly as recited in claim 13, wherein the controller assembly is comprised of buttons mounted on an outer surface and corresponding buttons mounted on an inner surface of the removable cover of the cushion.

15. A method for mounting a recliner assembly adjacent a modular furniture assembly comprising:

providing a modular furniture assembly with reclining assembly as recited in claim 1;

providing a first coupler configured to be placed within the modular furniture assembly and the reclining assembly;

providing a second coupler configured to be placed within the reclining assembly and the additional base;

placing the modular furniture assembly adjacent the reclining assembly and the additional base adjacent the reclining assembly;

mounting the first coupler within the modular furniture assembly and the reclining assembly, coupling them to one another; and mounting the second coupler within the reclining assembly and the additional base, coupling them to one another.

16. A method as recited in claim 15 wherein:

(i) the modular furniture assembly and the reclining assembly have a slit and passageway, respectively, therein, the first coupler being configured to be selectively mounted within the slit and passageway;

(ii) the reclining assembly and the additional base each have a respective slit therein, the second coupler being configured to be selectively mounted within the slits.

17. A method as recited in claim 16, wherein the first coupler selectively couples the reclining assembly to the modular furniture assembly, the first coupler being configured to remain in a stationary position when the footrest assembly of the reclining assembly moves back and forth between extended and non-extended positions, and wherein the second coupler selectively couples the additional base to the reclining assembly, the second coupling being configured to move when the footrest assembly of the reclining assembly moves back and forth between extended and non-extended positions.

18. A method as recited in claim 17, wherein the first and second couplers are U-shaped couplers that are substantially identical to one another.

19. A furniture system, comprising:

a modular furniture assembly having footprint specifications which identify the footprint of the modular furniture assembly, the modular furniture assembly comprising a base and a transverse member that can be selectively coupled to each other; and a reclining assembly configured to be selectively coupled to the modular furniture assembly, wherein the reclining assembly is configured to be mounted adjacent to the modular furniture assembly such that the reclining assembly can be selectively coupled to the modular furniture assembly to form a convenient, useful, and aesthetically pleasing sofa, wherein the reclining assembly includes (i) a housing; (ii) a footrest assembly that moves relative to the housing as the reclining assembly moves from a compressed, non-reclined position to an extended position; and (iii) a recliner mechanism configured to selectively move the footrest assembly with respect to the housing, wherein the footrest assembly includes at least one sled rail mounted on an underside of the footrest assembly.

20. A furniture system as recited in claim 19, wherein the footrest assembly includes an additional base that is separable from the remainder of the footrest assembly, the at least one sled rail being mounted on the underside of the additional base.

* * * * *